US005510222A

United States Patent [19]

Inaba et al.

[11] Patent Number: 5,510,222

[45] Date of Patent: Apr. 23, 1996

[54] TONER FOR DEVELOPING ELECTROSTATIC IMAGE AND PROCESS FOR PRODUCTION THEREOF

[75] Inventors: Kohji Inaba, Yokohama; Tatsuya Nakamura, Tokyo; Tatsuhiko Chiba, Kamakura; Takao Ishiyama, Kawasaki, all of Japan

[73] Assignee: Canon Kabushiki Kaisha, Tokyo, Japan

[21] Appl. No.: 243,932

[22] Filed: May 17, 1994

[30] Foreign Application Priority Data

| | | | |
|---|---|---|---|
| May 20, 1993 | [JP] | Japan | 5-118517 |
| May 27, 1993 | [JP] | Japan | 5-126180 |
| May 27, 1993 | [JP] | Japan | 5-126181 |

[51] Int. Cl.[6] ..... G03G 9/087

[52] U.S. Cl. ..... 430/109; 430/137

[58] Field of Search ..... 430/109, 137

[56] References Cited

U.S. PATENT DOCUMENTS

| | | | |
|---|---|---|---|
| 2,297,691 | 10/1947 | Carlson | 95/5 |
| 3,653,893 | 4/1972 | Jacknow et al. | 96/1.4 |
| 3,666,363 | 5/1972 | Tanaka et al. | 355/17 |
| 4,071,361 | 1/1978 | Marushima | 96/17.5 |
| 4,299,899 | 11/1981 | Azar et al. | 430/108 |
| 5,342,722 | 8/1994 | Ito et al. | 430/109 |
| 5,342,724 | 8/1994 | Wilson | 430/109 |
| 5,366,839 | 11/1994 | Aoki | 430/109 |
| 5,368,968 | 11/1994 | Wehrmann et al. | 430/109 |

FOREIGN PATENT DOCUMENTS

| | | |
|---|---|---|
| 0246814 | 11/1987 | European Pat. Off. . |
| 0471894 | 2/1992 | European Pat. Off. . |
| 52-3304 | 1/1977 | Japan . |
| 52-3305 | 1/1977 | Japan . |
| 57-52574 | 3/1982 | Japan . |
| 60-217366 | 10/1985 | Japan . |
| 60-252361 | 12/1985 | Japan . |
| 60-252360 | 12/1985 | Japan . |
| 61-94062 | 5/1986 | Japan . |
| 61-138259 | 6/1986 | Japan . |
| 61-273554 | 12/1986 | Japan . |
| 62-14166 | 1/1987 | Japan . |
| 1-109359 | 4/1989 | Japan . |
| 1-185662 | 7/1989 | Japan . |
| 1-185660 | 7/1989 | Japan . |
| 1-185661 | 7/1989 | Japan . |
| 1-195663 | 8/1989 | Japan . |
| 1-238672 | 9/1989 | Japan . |
| 2-79860 | 3/1990 | Japan . |
| 3-50559 | 3/1991 | Japan . |
| 3-91108 | 4/1991 | Japan . |
| 3-212752 | 9/1991 | Japan . |
| 3-242397 | 10/1991 | Japan . |
| 4-107467 | 4/1992 | Japan . |
| 4-149559 | 5/1992 | Japan . |
| 1371670 | 10/1974 | United Kingdom . |

*Primary Examiner*—John Goodrow

*Attorney, Agent, or Firm*—Fitzpatrick, Cella, Harper & Scinto

[57] ABSTRACT

A toner for developing an electrostatic latent image is constituted by a binder resin, a colorant, and an ester compound (a), (b) or (c) shown below: (a) a poly-functional ester having a tertiary carbon or/and a quaternary carbon and obtained from an alcohol compound or carboxylic compound having at least two functional groups, (b) a mono-functional ester having a tertiary carbon or/and a quaternary carbon, or (c) a poly-functional ester of a specific structure having a primary or secondary carbon having at least two functional groups. The ester compound is characterized by a good affinity with the binder resin, a high hydrophobicity and a low crystallinity, thereby providing a toner which shows good low-temperature fixability, anti-offset characteristic, color-mixing characteristic and transparency.

39 Claims, 2 Drawing Sheets

TONER FOR DEVELOPING ELECTROSTATIC IMAGE AND PROCESS FOR PRODUCTION THEREOF

FIELD OF THE INVENTION AND RELATED ART

The present invention relates to a toner for developing electrostatic images in image forming methods, such as electrophotography, and electrostatic printing, and also a process for production thereof.

Hitherto, a large number of electro-photographic processes have been known, as disclosed in U.S. Pat. Nos. 2,297,691; 3,666,363; 4,071,361 and others. In these processes, an electric latent image is formed on a photosensitive member comprising a photoconductive material by various means, then the latent image is developed and visualized with a toner, and the resultant toner image is, after being transferred onto a transfer-receiving material, such as paper, as desired, fixed by heating, pressing, heating and pressing, etc., to obtain a copy or a print. The residual toner remaining on the photosensitive member without being transferred is removed by various cleaning methods. The above steps are repeated.

A full color image may generally be formed in the following manner. A photosensitive drum is uniformly charged by a primary charger, exposed imagewise to laser light modulated by a magenta image signal from an original to form an electrostatic latent image on the photosensitive drum. The electrostatic image is then developed with a magenta developing device containing a magenta toner to form a magenta toner image on the photosensitive drum, which toner image is then transferred by a transfer charger onto a transfer-receiving material conveyed thereto.

Separately, the photosensitive drum after the development and transfer is charge-removed, cleaned by a cleaning member and again uniformly charged by a primary charger for a cyan toner image formation in a similar manner. The cyan toner image is transferred onto the transfer-receiving material carrying the magenta toner image. Further, a yellow toner image formation and transfer, and a black toner image formation and transfer, are successively performed in a similar manner. Thus, four-color toner images are transferred onto the transfer-receiving material. The transfer-receiving material carrying the four-color toner images is subjected to fixation under application of heat and pressure by fixing rollers to form a full color image.

In recent years, an image-forming apparatus performing an image forming method as described above not only is used as a business copier for simply reproducing an original but also has been used as a printer, typically a laser beam printer, for computer output and a personal copier for individual users.

In addition to such uses as representatively satisfied by a laser beam printer, the application of the basic image forming mechanism to a plain paper facsimile apparatus has been remarkably developed.

For such uses the image forming apparatus has been required to be smaller in size and weight and satisfy higher speed, higher quality and higher reliability. Accordingly, the apparatus has been composed of simpler elements in various respects. As a result, the toner used therefor is required to show higher performances so that an excellent apparatus cannot be achieved without an improvement in toner performance. Further, in accordance with various needs for copying and printing, a greater demand is urged for color image formation, and a higher image quality and a higher resolution are required for faithfully reproducing an original color image. In view of these requirements, a toner used in such a color image forming method is required to exhibit a good melting characteristic and color-mixing characteristic on heating. Thus, it is desirable to use a toner of a sharp melting characteristic having a low softening point and a low melt-viscosity.

By using such a sharp-melting toner, a range of color reproduction can be broadened to provide a color copy faithful to an original image. Such a sharp-melting toner, however, shows a high affinity to a fixing roller and is liable to be offset onto the fixing roller at the time of fixation.

Particularly, in the case of a fixing device for a color image forming apparatus, a plurality of toner layers including those of magenta toner, cyan toner, yellow toner and black toner, are formed on a transfer-receiving material, so that the offset is particularly liable to be caused as a result of an increased toner layer thickness.

Hitherto, in order to prevent the attachment of a toner onto a fixing roller surface, it has been practiced to compose the roller surface of a material, such as a silicone rubber or a fluorine-containing resin, showing excellent releasability against a toner, and coat the roller surface with a film of a liquid showing a high releasability, such as silicone oil or a fluorine-containing oil, for the purpose of preventing offset and deterioration of the roller surface. However, such a measure, though very effective for preventing toner offset, requires a equipment for supplying the offset-preventing liquid and complicates the fixing device. Further, the oil application is accompanied with another difficulty that peeling between elastic layers constituting the fixing roller is caused thereby which shortens the life of the fixing roller.

The transfer receiving material carrying a toner image to be fixed by such a fixing device may generally comprise various types of paper, coated paper, and plastic film. In recent years, transparency films for an overhead projector (OHP films) have been frequently used for presentation, etc. An OHP film, unlike paper, has a low oil-absorption capacity and cannot obviate a sticky touch in case of oil application, thus leaving room for improvement regarding the resultant image quality. Further, silicone oil is liable to be evaporated on heat application to soil the interior of the apparatus. It is also necessary to treat the recovered oil. Accordingly, based on a concept of dispensing with a silicone oil applicator and supplying an offset-preventing liquid from the inside of the toner on heating, it has been known to add a release agent, such as low-molecular weight polyethylene or low-molecular weight polypropylene in the toner. However, in case where such a release agent is added in a large quantity so as to exhibit a sufficient effect, the release agent is liable to cause a filming onto the photosensitive member surface and soil the surface of a carrier or a developing sleeve, thus causing image deterioration. Accordingly, it has been known to incorporate in the toner a release agent in a small amount not causing image deterioration and to supply a small amount of a release oil or clean the toner attached onto the fixing roller by a winding-up type cleaning web or a cleaning pad.

However, in view of recent demand for a smaller, lighter and more reliable apparatus, it is preferred to dispense with even such auxiliary means. These requirements cannot be complied with unless the fixability and anti-offset characteristics of a toner are further improved.

Further, in the field of a full-color image formation, when a toner containing a release agent is transferred onto an OHP, the resultant image after fixation is liable to provide a lower transparency or an increased haze because of the crystallinity of the release agent and a difference in refractive index with the resin.

Incorporation of a wax as a release agent in a toner has been proposed in Japanese Patent Publication (JP-B) 52-3304, JP-B 52-3305, and Japanese Laid-Open Patent Application (JP-A) 57-52574.

Similar proposals have also been made in JP-A 3-50559, JP-A 2-79860, JP-A 1-109359, JP-A 62-14166, JP-A 61-273554, JP-A 61-94062, JP-A 61-138259, JP-A 60-252361, 3P-A 60-252360, and JP-A 60-217366.

Such a wax has been used to improve the anti-offset characteristic of a toner at a low temperature or a high temperature and the fixability of a toner at a low temperature. On the other hand, the use of a wax may be accompanied with difficulties such as a lowering in anti-blocking characteristic, a deterioration in developing performance when exposed to heat due to heating of a copying machine, etc., and a deterioration in developing performance due to migration of the wax to the toner surface when the toner is left standing for a long period.

Use of a conventional toner has involved some unsatisfactory points such that the toner shows unsatisfactory low-temperature fixability while it shows satisfactory high-temperature anti-offset characteristic and developing performance; the toner has somewhat inferior anti-blocking characteristic and causes a lower developing performance on temperature increase in the apparatus while it shows low-temperature anti-offset characteristic and low-temperature fixability; the toner fails to compatibly satisfy low-temperature and high-temperature anti-offset characteristic or the toner can provide an OHP film with remarkably inferior transparency.

Regarding particularly the transparency of an OHP film, there have been made some proposals, such as: the addition of a crystal nucleation agent into a wax in order to suppress the crystallization of the wax (JP-A4-149559, JP-A4-107467); the use of a wax showing a low crystallinity (JP-A3-091108, JP-A3-242397); and the addition of a substance showing a good mutual solubility with a binder and a lower melt viscosity than the binder so as to improve the surface smoothness of the toner image after the fixation (JP-A 3-212752).

Montan wax which is a mineral wax, has been known as a release agent showing a relatively good transparency and a low-temperature fixability.

The use of a montan-type wax having a molecular weight of about 800 and represented by the formula:

$$R-\overset{\overset{\displaystyle O}{\|}}{C}-O-(CH_2-CH_2)_n-O-\overset{\overset{\displaystyle O}{\|}}{C}-R,$$

wherein R denotes a $C_{28}$–$C_{32}$ hydrocarbon group and n denotes an integer, has been proposed in JP-A 1-185660, JP-A 1-185661, JP-A 1-185662, JP-A 1-195663, and JP-A 1-238672. However, a toner containing such a wax has left room for improvement regarding the transparency and the haze of the resultant OHP film.

SUMMARY OF THE INVENTION

An object of the present invention is to provide a toner for developing electrostatic images having solved the above-mentioned problems and a process for production thereof.

An object of the present invention is to provide a toner for developing electrostatic images showing excellent low-temperature fixability onto a transfer-receiving material and anti-offset characteristic, and a process for production thereof.

An object of the present invention is to provide a toner for developing electrostatic images which can be fixed well without applying a large quantity of oil or while completely dispensing with oil application, and a process for production thereof.

A further object of the present invention is to provide a full color toner capable of providing a high-quality full-color OHP film excellent in transparency, and a process for production thereof.

According to the present invention, there is provided a toner for developing an electrostatic latent image, comprising: a binder resin, a colorant, and an ester compound (a), (b) or (c) shown below:

(a) a poly-functional ester having a tertiary carbon or/and a quaternary carbon and obtained from an alcohol compound or carboxylic compound having at least two functional groups, (b) a mono-functional ester having a tertiary carbon or/and a quaternary carbon, or (c) a poly-functional ester having a primary or secondary carbon having at least two functional groups represented by the following formula (1):

$$R_1-\underset{\underset{\displaystyle Z_1}{\|}}{C}-X_1\left(CH_2\right)_m-\underset{\underset{\displaystyle Y_2}{|}}{\overset{\overset{\displaystyle Y_1}{|}}{A}}\left(CH_2\right)_n-X_2-\underset{\underset{\displaystyle Z_2}{\|}}{C}-R_2, \quad (1)$$

wherein A denotes a carbon atom or alicyclic group, $R_1$ and $R_2$ independently denote an organic group having 1– 35 carbon atoms, $Y_1$ and $Y_2$ independently denote a hydrogen atom, halogen atom or organic group, m and n denote 0 or an integer of at least 1, $X_1$ and $X_2$ independently denote an oxygen atom or sulfur atom, and $Z_1$ and $Z_2$ independently denote an oxygen atom or sulfur atom, with the proviso that at least one of $Y_1$ and $Y_2$ denotes an organic group when A denotes a carbon atom and m and n are 0, at least one of $Y_1$ and $Y_2$ denotes a hydrogen atom or halogen atom when A denotes a carbon atom and either one of m and n denotes an integer of at least 1, and $Y_1$ and $Y_2$ denote a hydrogen atom or halogen atom with the proviso that at least one of $Y_1$ and $Y_2$ is a halogen atom when A denotes a carbon atom and m and n are an integer of at least 1.

According to another aspect of the present invention, there is provided a process for producing a toner as described above, comprising the steps of:

(i) melt-kneading a mixture including the above-mentioned binder resin, colorant and ester compound (a), (b) or (c) to form a melt-kneaded product, (ii) cooling the melt-kneaded product, (iii) pulverizing the cooled melt-kneaded product to obtain a pulverized product, and (iv) classifying the pulverized product to obtain toner particles.

According to further aspect of the present invention, there is provided a process for producing a toner as described above, comprising the steps of:

(i) forming a mixture including a polymerizable monomer, a colorant and the above-mentioned ester compound (a), (b) or (c) into particles, and (ii) polymerizing the particles of the mixture to obtain toner particles.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
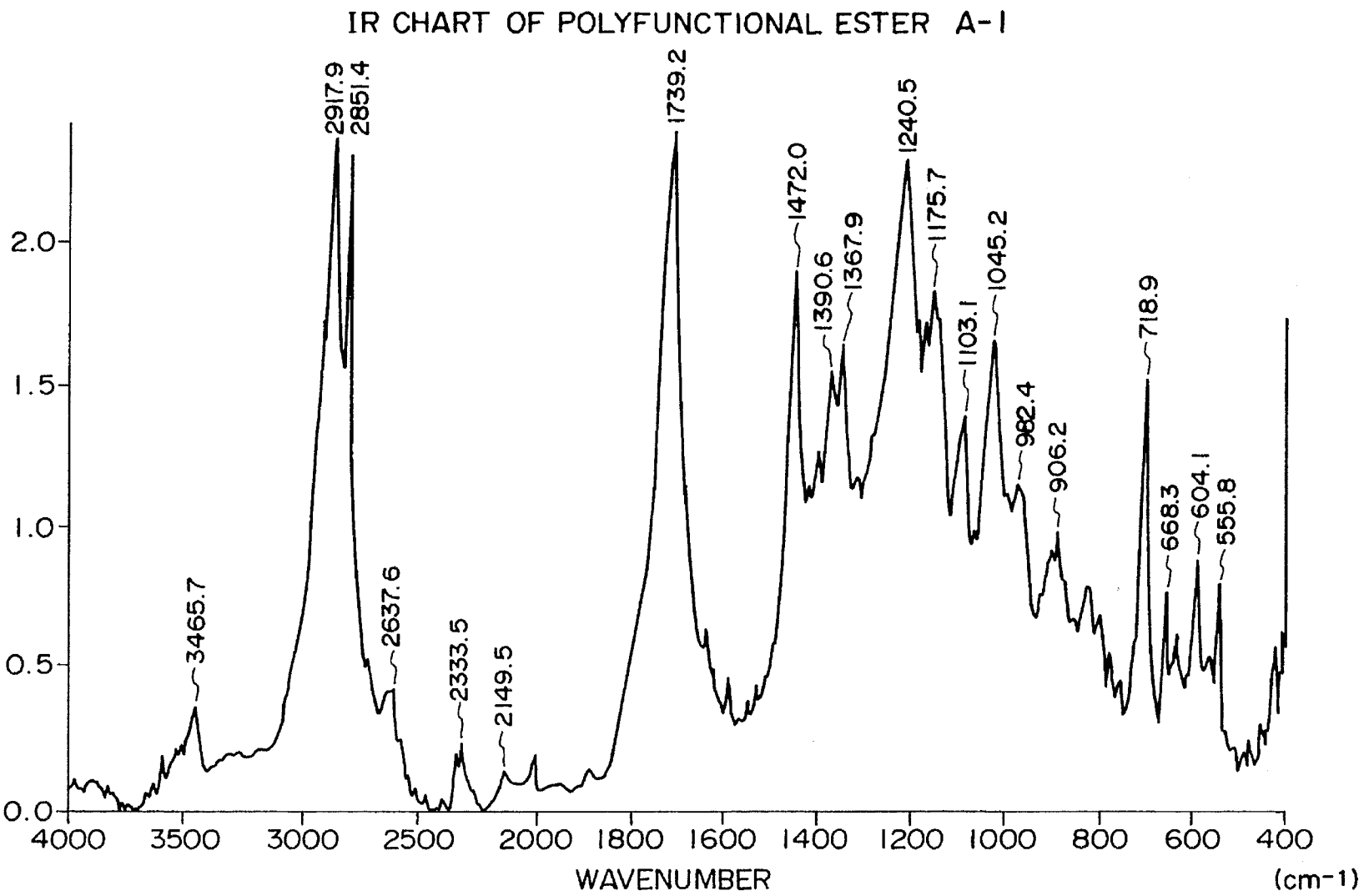
FIG. 1 is an infrared absorption spectrum chart of poly-functional ester A-1.

A representative class of examples of the ester compound (a) used in the present invention may principally include poly-functional esters represented by the following structural formula (2):

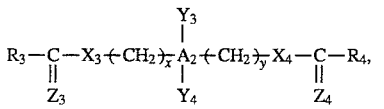

(2)

wherein $A_2$ denotes a carbon atom, allcyclic group or aromatic group, $R_3$ and $R_4$ independently denote an organic group having 1–35 carbon atoms, $Y_3$ and $Y_4$ independently denote a hydrogen atom, halogen atom or organic group, x and y denote zero or an integer of at least 1, $X_3$ and $X_4$ independently denote an oxygen atom or sulfur atom, and $Z_3$ and $Z_4$ independently denote an oxygen atom or sulfur atom, with the proviso that x and y denote an integer of at least 1 when $A_2$ denoted a carbon atom and either one of $Y_3$ and $Y_4$ denotes an organic group; either one of x and y denotes an integer of at least 1 when $A_2$ denotes a carbon atom and $Y_3$ and $Y_4$ both denote an organic group; x and y denote 0 or an integer of at least 1 when $A_2$ denotes an aromatic group having $Y_3$ and $Y_4$; and at least one of $Y_3$ and $Y_4$ denotes an organic group when $A_2$ denotes an alicyclic group having $Y_3$ and $Y_4$ and x and y are 0.

Examples of the organic group denotes by $Y_3$ in the poly-functional ester represented by the formula (2) may include those represented by the formula:

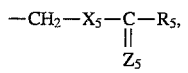

wherein $R_5$ denotes an organic group having 1–35 carbon atoms, $X_5$ denotes an oxygen or sulfur atom, and $Z_5$ denotes an oxygen or sulfur atom; and examples of the organic group denoted by $Y_4$ may include those represented by the formula:

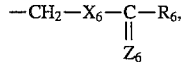

wherein $R_6$ denotes an organic group having 1–35 carbon atoms, $X_6$ denotes an oxygen or sulfur atom, and $Z_6$ denotes an oxygen or sulfur atom In the poly-functional ester represented by the above formula (2), it is preferred that the chain length of $R_3$ and/or $R_4$ is made sufficiently longer than that of $Y_3$ and/or $Y_4$ in order to provide a good combination of low-temperature fixability and transparency. It is particularly effective to use a poly-functional ester wherein $R_3$ and $R_4$ are organic groups having 10–35 carbon atoms, and $R_5$ and $R_6$ are organic groups having 1–5 carbon atoms.

A particularly preferred class of poly-functional esters are those represented by the following formula:

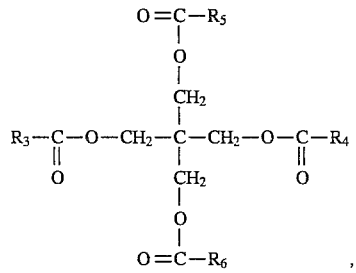

wherein $R_3$ and $R_4$ denote an alkyl or alkenyl group having 11–30 carbon atoms, and $R_5$ and $R_6$ denote an alkyl group having 1–10 carbon atoms, preferably 1–6 carbon atoms.

Specific examples of the ester compound (a) may include poly-functional esters A-1 to A-27 as shown below.

Polyfunctional ester A-1

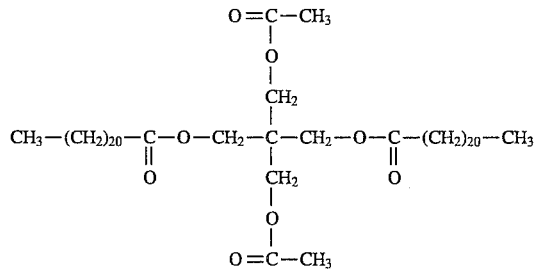

Polyfunctional ester A-2

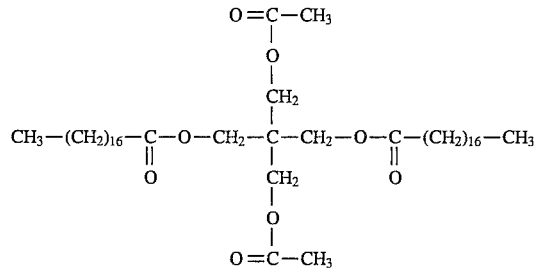

Polyfunctional ester A-3

-continued
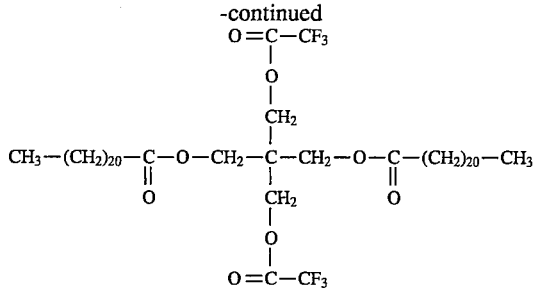
Polyfunctional ester A-4
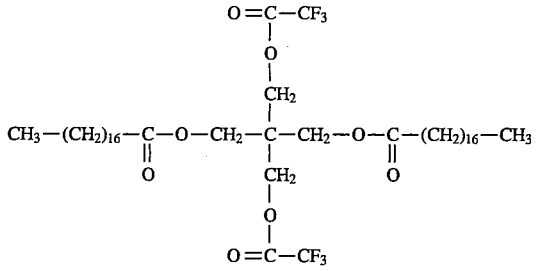
Polyfunctional ester A-5
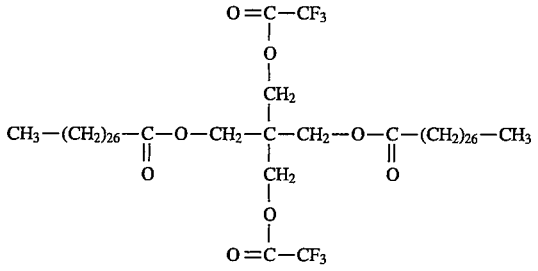
Polyfunctional ester A-6
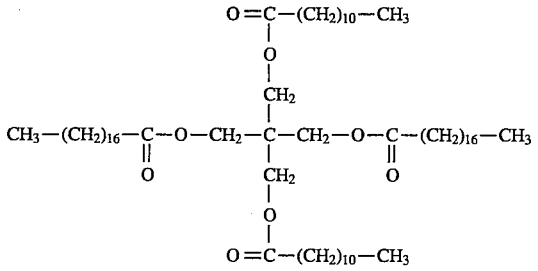
Polyfunctional ester A-7
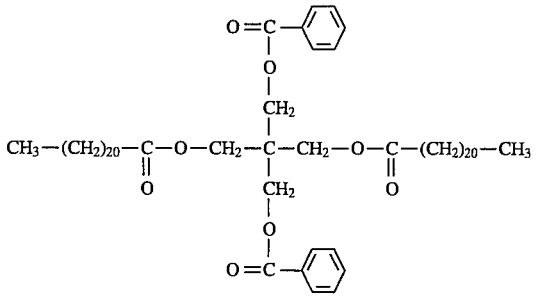
Polyfunctional ester A-8
-continued
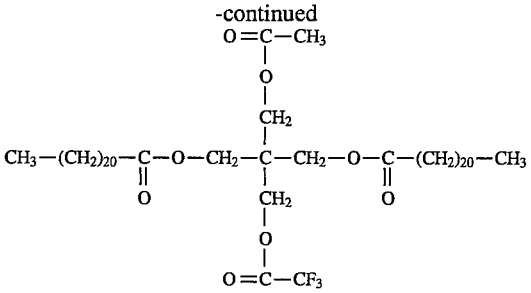
Polyfunctional ester A-9
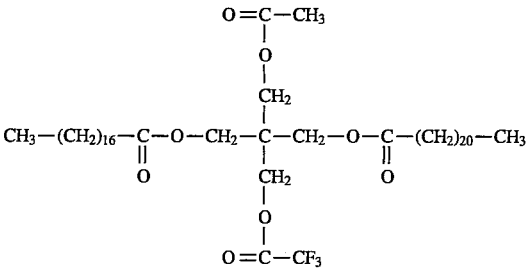
Polyfunctional ester A-10
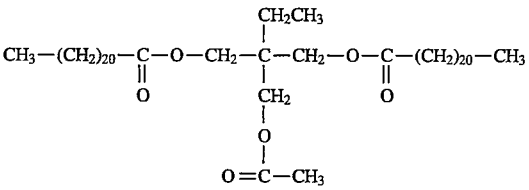
Polyfunctional ester A-11
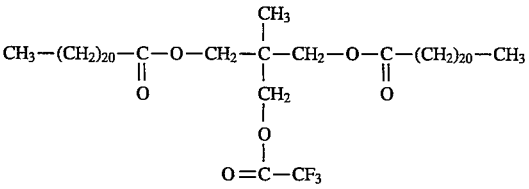
Polyfunctional ester A-12
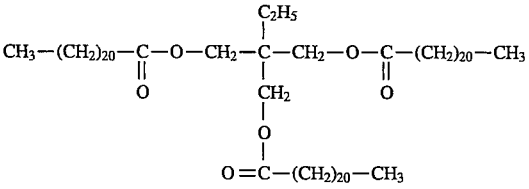
Polyfunctional ester A-13
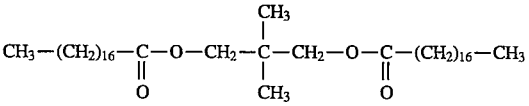
Polyfunctional ester A-14
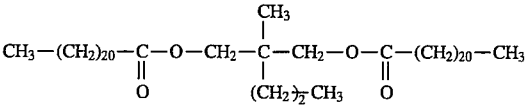
Polyfunctional ester A-15

-continued

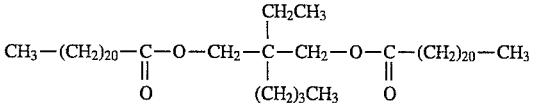

Polyfunctional ester A-16

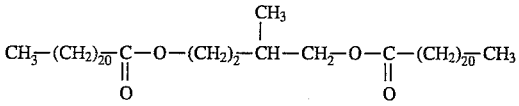

Polyfunctional ester A-17

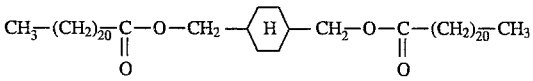

Polyfunctional ester A-18

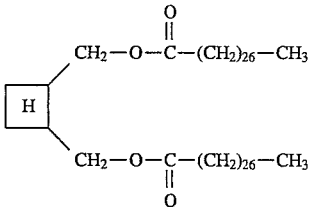

Polyfunctional ester A-19

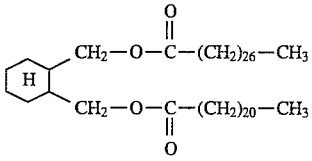

Polyfunctional ester A-20

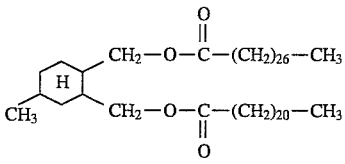

Polyfunctional ester A-21

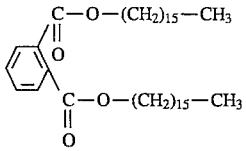

Polyfunctional ester A-22

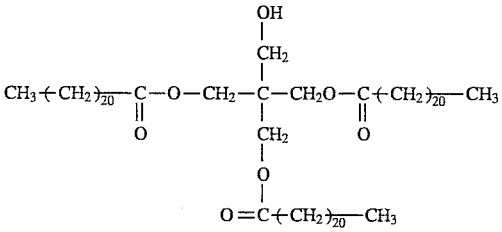

Polyfunctional ester A-23

-continued

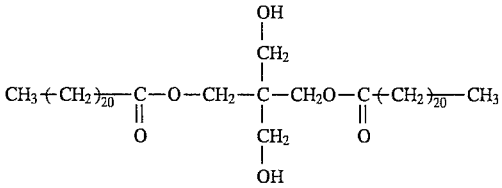

Polyfunctional ester A-24

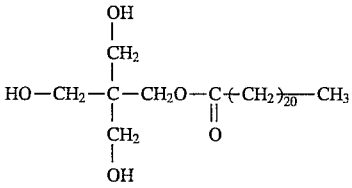

Polyfunctional ester A-25

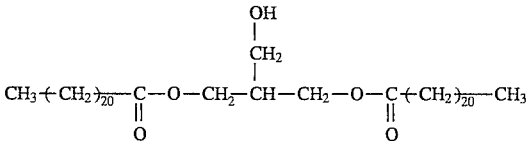

Polyfunctional ester A-26

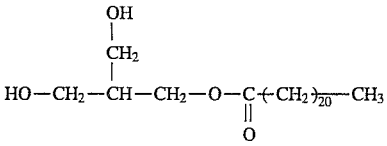

Polyfunctional ester A-27

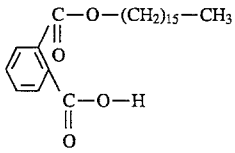

A representative class of examples of the ester compound (b ) (i.e., mono-functional ester) may principally include those represented by the following structural formula (3):

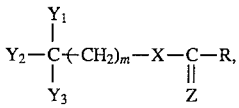

(3)

wherein R denotes an organic group having 1–35 carbon atoms: $Y_1$, $Y_2$ and $Y_3$ independently denote a hydrogen atom, halogen atom or organic group; X denotes an oxygen or sulfur atom; Z denotes an oxygen or sulfur atom; and m denotes zero or an integer of at least 1 with the proviso that $Y_1$, $Y_2$ and $Y_3$ respectively denote an organic group when m=0.

Specific examples of the ester compound (b) may include mono-functional esters B-1 to B-6 as shown below:

Mono-functional ester B-1

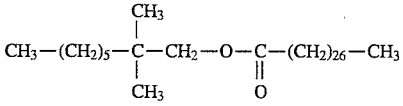

Mono-functional ester B-2

-continued

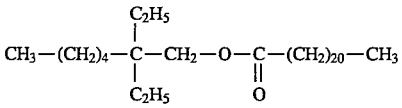

Mono-functional ester B-3

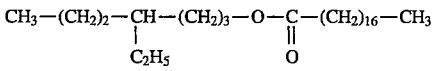

Mono-functional ester B-4

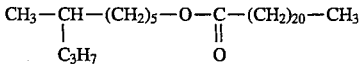

Mono-functional ester B-5

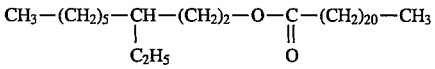

Mono-functional ester B-6

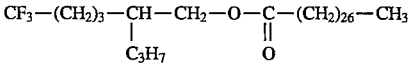

In the ester compound (c), i.e., poly-functional ester represented by the formula (1) having a primary or secondary carbon and at least two functional groups, examples of the organic group denoted by $Y_1$ may include those represented by the formula:

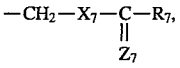

wherein $R_7$ denotes an organic group having 1–35 carbon atoms, $X_7$ denotes an oxygen or sulfur atom, and $Z_7$ denotes an oxygen or sulfur atom; and examples of the organic group denoted by $Y_2$ may include those represented by the formula:

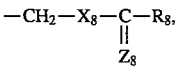

wherein $R_8$ denotes an organic group having 1–35 carbon atoms, $X_8$ denotes an oxygen or sulfur atom, and $Z_8$ denotes an oxygen or sulfur atom.

Specific examples of the ester compound (c) may include poly-functional esters C-1 to C-27 as shown below.

Poly-functional ester C-1

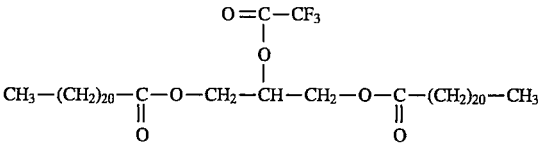

Poly-functional ester C-2

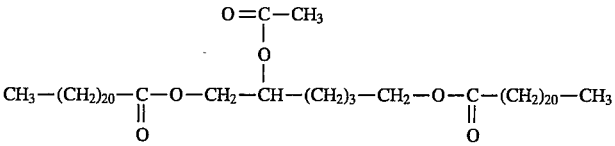

Poly-functional ester C-3

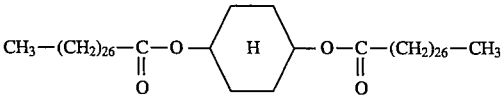

Poly-functional ester C-4

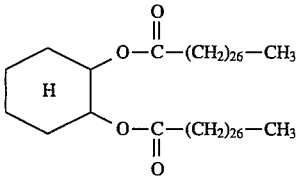

Poly-functional ester C-5

-continued

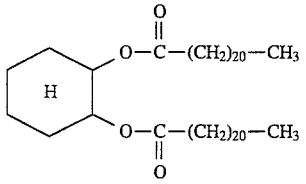

Poly-functional ester C-6

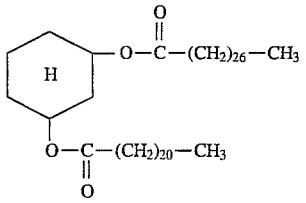

Poly-functional ester C-7

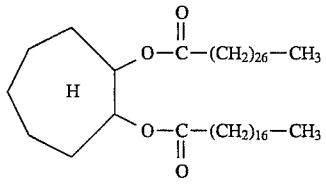

Poly-functional ester C-8

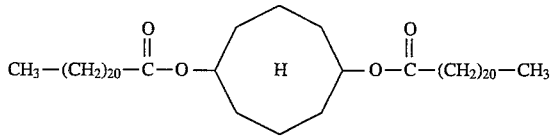

The ester compound used in the present invention as described above is a compound of a low crystallinity which has an appropriate degree of affinity with a binder resin so as to develop a low-temperature fixability, has a high hydrophobicity and has a low melting point. As a result of our study, it has been found necessary to suppress the crystallinity of a release agent by depriving the release agent of its structural symmetry in order to further improve the transparency.

The ester compound may be used in a proportion of 1–40 wt. parts, preferably 2–30 wt. parts, per 100 wt. parts of the binder resin constituting the toner.

More specifically, in case of dry process production for producing toner particles through melt-kneading, cooling and pulverization of a mixture including the binder resin, a colorant and the ester compound, the ester compound may preferably be used in a proportion of 1–10 wt. parts, more preferably 2– 5 wt. parts, per 100 wt. parts of the binder resin.

On the other hand, in case of polymerization process toner production wherein toner particles are directly obtained by polymerization of a mixture including a polymerizable monomer, a colorant and the ester compound, the ester compound may preferably be used in a proportion of 10–40 wt. parts, more preferably 15–30 wt. parts, per 100 wt. parts of the polymerizable monomer.

In the polymerization process toner production compared with the dry process toner production, a larger amount of the release agent can be incorporated in toner particles during polymerization in an aqueous medium because the release agent is ordinarily of a lower polarity than the binder resin. This is particularly advantageous in providing an anti-offset effect at the time of fixation.

If the amount of the ester compound is below the lower limit, the anti-offset effect is liable to be lowered. If the amount exceeds the upper limit, the resultant toner is liable to suffer from difficulties, such as a lower anti-blocking effect, an adverse effect to the anti-offset effect, liability of melt-sticking onto the photosensitive drum and developing sleeve, and liability of having a broader particle size distribution in the case of a polymerization process toner.

In order to provide a sufficiently transparent image on an OHP film, it is generally most important to lower the crystallinity of the release agent contained in the toner. However, as a secondary effect in order to provide a sufficient transparency, it is necessary to consider such phenomena that partially yet-unmelted toner grain or crystalline structure of the release agent layer remaining after the fixation causes random reflection of incident light, thus resulting in effective reduction of optical transparency and increased haze. Further, even if the components are sufficiently melt-mixed at the time of fixation, the random reflection of incident light can be caused if there is a large difference in refractive index between the toner layer formed after the melt-mixing and the release agent layer formed thereon.

The increase in random reflection of incident light leads to a lowered brightness and a lowered clarity of a projected image. This difficulty is enhanced in case of a light transmission type overhead projector than a reflection-type overhead projector.

In order to reduce the crystallization of the release agent, it is important to lower the crystallinity of the release agent per se. Further, in order not to allow the presence of unmelted toner grain in the fixed toner layer, it is preferred to adjust the glass transition temperature (Tg) of the binder resin and the melting point (m.p.) of the release agent showing a low melting enthalpy (ΔH), which is a latent heat of melting of the release agent, so as to allow quick melting at a low energy. In order to have the melted release agent quickly move to between the binder resin layer and the fixing member so as to form an offset-prevention layer, it is preferred to provide an appropriate difference in solubility parameter (SP) between the binder resin and the release agent.

In view of the above-described points, preferred features of the present invention will be described in further detail below.

The ester compound functioning as a release agent in the present invention may preferably have a refractive index close to that of an ordinary toner binder resin, such as polyester resin, styrene-acrylate resin, epoxy resin, and styrene-butadiene resin. The refractive index may be measured for example in the following manner. A solid sample measuring 20–30 mmL×8 mmW×3–10 mm (in thickness) is applied onto a prism surface with a small amount of bromonaphthalene therebetween applied in advance onto the prism surface so as to improve the contact therebetween, and the refractive index is measured by means of a refractometer (e.g., "Abbe Refractometer 2T", avail-able from Atago K.K.).

The refractive index difference between the binder resin and the ester compound may preferably be at most 0.18, and more preferably at most 0.10, as measured at 25° C. It is also effective to introduce a hetero-ester group by substitution of a hetero element, such as sulfur for oxygen in the ester group for the refractive index adjustment. If the refractive index difference exceeds 0.18, the resultant OHP film image is liable to have a lower transparency and have a lowered brightness particularly in providing a halftone projected image.

The ester compound used in the present invention may preferably have a melting point of 30°– 120° C., more preferably 50°–100° C. If the melting point is below 30° C., the resultant toner is liable to be poor in anti-blocking characteristic and soil the sleeve and photosensitive member after a large number of successive copies. If the melting point is above 120° C., an excessively large energy is required in homogenous mixing with the binder resin in the case of toner production through the pulverization process and, in the case of toner production through the polymerization process, the use of a high-boiling point solvent and a complicated apparatus including a high pressure resistant reaction vessel are required.

The solubility parameter (SP value) may for example be calculated based on the Fedors' method (Polym. Eng. Sci., 14(2) 147 (1974)) utilizing the additivity of atomic groups.

The ester compound used in the present invention may preferably have an SP value in the range of 7.5–9.7. An ester compound having an SP value of below 7.5 shows a poor compatibility (mutual solubility) with the binder resin, so that it is difficult to obtain a good dispersion state within the binder resin As a result, the ester compound is liable to attach onto the developing sleeve and cause a change in triboelectric chargeability of the toner during a large number of successive image formations. Further, ground fog and density change at the time of toner replenishment are also liable to occur If an ester compound having an SP value in excess of 9.7 is used, the resultant toner particles are liable to cause blocking during a long term of storage. Further, since such an ester compound shows excessively good compatibility with the binder resin it is difficult to form a sufficient release layer between the fixing member and the toner binder resin layer at the time of fixation, so that offset phenomenon is liable to occur.

The melt viscosity of the ester compound used in the present invention may for example be measured at 130° C. by using, e.g., "VP-500" (available from HAAKE Co.) equipped with a cone plate-type rotor ("PK-1). The melt viscosity at 130° C. may preferably be 1–300 cps, further preferably 3–50 cps. If the melt viscosity is below 1 cps, when the resultant toner is used in a non-magnetic one-component development system and applied by a blade, etc., onto a developing sleeve to form a thin toner layer thereon, the toner is liable to soil the sleeve due to a mechanical shearing force. Also in the two-component development system using a carrier together with a toner, the toner is liable to be damaged by a shearing force acting between the toner and the carrier, whereby the embedding of an external additive and breakage of the toner are liable to occur. If the melt viscosity exceeds 300 cps, it is difficult to obtain uniformly minute toner particles because of an excessively high viscosity of the polymerizable monomer mixture in case of toner production through the polymerization process, thus resulting in a toner having a broad particle size distribution.

The hardness of the ester compound may be measured by using, e.g., a dynamic ultra-minute hardness meter ("DUH-200", available from Shimazu Seisakusho K.K.) in the following manner. An ester compound is melted and molded into a 5 mm-thick cylindrical pellet in a 20 mm dia-mold. The sample is pressed by a Vickers pressure element at a load of 0.5 g and a loading rate of 9.67 mg/sec to cause a displacement of 10 μm, followed by holding for 15 sec. Then, the pressed mark on the sample is analyzed to measure a Vickers hardness. The ester compound used in the present invention may preferably have a Vickers hardness in the range of 0.3–5.0, further preferably 0.5–3.0.

A toner containing an ester compound having a Vickers hardness of below 0.3 is liable to be broken at the cleaning position in the apparatus and cause toner sticking onto the photosensitive drum, thus being liable to provide black streaks in the resultant images, during a large number of successive image formings. Further, when a plurality of image samples are stacked together and stored, then the so-called transfer, i.e., the transfer of the toner onto the back, is liable to occur. A toner containing an ester compound having a Vickers hardness in excess of 5.0, requires an excessively high pressure by a fixing device at the time of hot-pressure fixation. Accordingly such a fixing device is designed to have a large mechanical strength. When such a toner is used in a fixing device of conventional pressure, it is liable to show a poor anti-offset characteristic.

The ester compound used in the present invention may preferably show a crystallinity of 10– 50%, more preferably 20–35%. If the crystallinity is below 10%, the resultant toner is liable to show poor storability and flowability. In excess of 50%, it is liable to provide an OHP image with a poor transparency.

The crystallinity referred to herein is based on values calculated by the following equation based on the areal ratio between the amorphous scattering peak and the crystalline scattering peak without using a calibration curve:

Crystallinity =crystalline component/total component

The measurement may be performed according to the transmission rotation method at a measurement angle 2θ range of 5–35 deg. by using, e.g., "Rotor Flex RU300" (available from Rigaku Denki K.K., Cu-target, point focus, output: 50 KV/250 mA).

The number-average molecular weight of the ester compound may be measured according to the vapor-pressure osmometry (VPO) method, e.g., under the following conditions:

Apparatus: Molecular-weight measuring apparatus ("Model 115", available from Hitachi K.K.)

Temperature: 61° C.

Solvent: toluene (reagent grade special)

Standard sample: benzyl (reagent grade special)

First, a ΔR-average mol concentration calibration curve is obtained by the benzyl standard sample. The number-average molecular weight (Mn) may be calculated from the following equation based on the sample concentration calculated from the used sample weight and the average mol concentration read from the calibration curve corresponding to the measured ΔR for the sample.

Mn=sample concentration (g/kg)/(average mol concentration (g/kg)

The ester compound may preferably have an Mn of 200–2000, more preferably 500–1000.

An ester compound having an Mn below 200 is liable to have to low a melting point and an inferior anti-blocking characteristic. An ester compound having an Mn exceeding 2000 is liable to show a lower releasing effect and provide an OHP film having a lower transparency.

The ester compound used in the present invention may be produced, e.g., by synthesis including an oxidation reaction, synthesis from a carboxylic acid or its derivative, or an ester group-introduction reaction as represented by the Michael addition reaction. The poly-functional ester used in the present invention may particularly preferably be formed through dehydrocondensation between a carboxylic acid compound and an alcohol compound, or reaction between an acid halide and an alcohol compound as represented by the following reaction schemes:

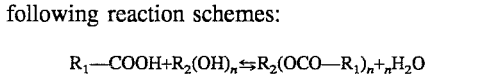

$$R_1\text{—}COOH+R_2(OH)_n \leftrightarrows R_2(OCO\text{—}R_1)_n+{}_nH_2O$$

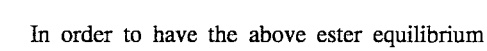

$$R_1\text{—}COCl+R_2(OH)_n \leftrightarrows R_2(OCO\text{—}R_1)_n+{}_nHCl$$

In order to have the above ester equilibrium reactions proceed to the right sides, an excessive amount of the alcohol may be used or the reaction may be performed in an aromatic organic solvent capable of forming an azeotrope with water by using a Dean-Stark water separator. It is also possible to synthesize the poly-functional ester by using an acid halide in an aromatic organic solvent while adding a base as a receptor of an acid by-produced in the reaction.

The binder resin for the toner of the present invention may for example comprise: homopolymers of styrene and derivatives thereof such as polystyrene poly-p-chlorostyrene and polyvinyltoluene; styrene copolymers such as styrene-p-chlorostyrene copolymer, styrene-vinyltoluene copolymer, styrene-vinylnaphthalene copolymer, styrene-acrylate copolymer, styrene-methacrylate copolymer, styrene-methyl-α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene- isoprene copolymer and styrene-acrylonitrile-indene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinyl butyral, terpene resin, coumarin-indene resin and petroleum resin. Preferred classes of the binder resin may include styrene copolymers and polyester resins.

Examples of the comonomer constituting such a styrene copolymer together with styrene monomer may include other vinyl monomers inclusive of: monocarboxylic acids having a double bond and derivatives thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and derivatives thereof, such as maleic acid, butyl maleate, methyl maleate and dimethyl maleate; vinyl esters, such as vinyl chloride, vinyl acetate, and vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether, and vinyl isobutyl ether. These vinyl monomers may be used alone or in mixture of two or more species in combination with the styrene monomer.

The THF-soluble portion of the binder resin may preferably have a number-average molecular weight of 3,000 to 1,000,000.

It is possible that the binder resin inclusive of styrene polymers or copolymers has been crosslinked or can assume a mixture of crosslinked and non-crosslinked polymers.

The crosslinking agent may principally be a compound having two or more double bonds susceptible of polymerization, examples of which may include: aromatic divinyl compounds, such as divinylbenzene, and divinylnaphthalene; carboxylic acid esters having two double bonds, such as ethylene glycol diacrylate, ethylene glycol dimethacrylate and 1,3-butanediol dimethacrylate; divinyl compounds, such as divinylaniline, divinyl ether, divinyl sulfide and divinylsulfone; and compounds having three or more vinyl groups. These may be used singly or in mixture. The crosslinking agent may preferably be added in a proportion of 0.001–10 wt. parts per 100 wt. parts of the polymerizable monomer.

The toner according to the present invention can further contain a negative or positive charge control agent.

Examples of the negative charge control agent may include: organic metal complexes and chelate compounds inclusive of monoazo metal complexes acetylacetone metal complexes, and organometal complexes of aromatic hydroxycarboxylic acids and aromatic dicarboxylic acids. Other examples may include: aromatic hydroxycarboxylic acids, aromatic mono- and poly-carboxylic acids, and their metal salts, anhydrides and esters, and phenol derivatives, such as bisphenols.

Further examples may include: urea derivative, metal-containing salicylic acid-based compounds, quaternary ammonium salts, calixarene, silicon compound, styrene-acrylic acid copolymer, styrene-methacrylic acid copolymer, styrene-acryl-sulfonic acid copolymer, and non-metallic carboxylic acid-based compounds.

Examples of the positive charge control agents may include: nigrosine and modified products thereof with aliphatic acid metal salts, etc., onium salts inclusive of quaternary ammonium salts, such as tributylbenzylammonium 1-hydroxy-4-naphtholsulfonate and tetrabutylammonium tetrafluoroborate, and their homologs inclusive of phosphonium salts, and lake pigments thereof; triphenylmethane dyes and lake pigments thereof (the laking agents including, e.g., phosphotungstic acid, phosphomolybdic acid, Phosphotungsticmolybdic acid, tannic acid, lauric acid, gallic acid, ferricyanates, and ferrocyanates); higher aliphatic acid metal salts; diorganotin oxides, such as dibutyltin oxide, dioctyltin oxide and dicyclohexyltin oxide; and diorganotin borates, such as dibutyltin borate, dioctyltin borate and dicyclohexyltin borate. These may be used singly or in mixture of two or more species. Among these, nigrosine compounds and organic quarternary ammonium salts are particularly preferred.

These charge control agents may preferably be used in a proportion of 0.01–20 wt. parts, more preferably 0.5–10 wt. parts, per 100 wt. parts of the resin component.

As for the toner colorant, examples of the black pigments may include: carbon black, aniline black, and acetylene black.

Examples of the magenta pigments may include: Orange Chrome Yellow, Molybdenum Orange, Permanent Orange GTR, Pyrazolone Orange, Benzidine Orange G, Cadmium Red, Permanent Red 4R, Watching Red Ca salt, eosine lake; Brilliant Carmine 3B, Carmine 6B; Manganese Violet, Fast Violet B, Methyl Violet Lake, Rhodamine Lake, alizarine lake, red iron oxide, quinacridone; C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209; C.I. Pigment Violet 19; and C.I. Violet 1, 2, 10, 13, 15, 23, 29, 35.

Examples of the cyan pigments may include: C.I. Pigment Blue 2, 3, 15, 16, 17; C.I. Vat Blue 6: C.I. Acid Blue 45, Indanthrene Blue, Ultramarine, Cobalt Blue, Alkali Blue Lake, Victoria Blue Lake, Phthalocyanine Blue, Fast Sky Blue, Indanthrene Blue BC<Chrome Green, chromium oxide, Pigment Green B, Malachite Green Lake, and Final Yellow Green G.

Examples of the yellow pigments may include: Naphthol Yellow, Hansa Yellow, Chrome Yellow, Cadmium Yellow, Mistral Fast Yellow, Navel Yellow, Permanent Yellow NCG, Tartrazine Lake; C.I. Pigment Yellow 1, 2, 3, 4, 5, 6, 7, 10, 11, 12, 13, 14, 15, 16, 17, 23, 65, 73, 83, 97, 120, 127, 174, 176, 180, 191; and C.I. Vat Yellow 1, 3, 20.

These pigments may be used in a quantity sufficient to provide a sufficient optical density of a fixed image and more specifically in an amount of 0.1–20 wt. parts, preferably 0.2–10 wt. parts, per 100 wt. parts of the resin.

The dyes used as the colorants may include the following.

Examples of the magenta dyes may include: C.I. Solvent Red 1, 3, 8, 23, 24, 25, 27, 30, 49, 81, 82, 83, 84, 100, 109, 121; C.I. Disperse Red 9; C.I. Solvent Violet 8, 13, 14, 21, 27; C.I. Disperse Violet 1; C.I. Basic Red 1, 2, 9, 12, 13, 14, 15, 17, 18, 22, 23, 24, 27, 29, 32, 34, 35, 36, 37, 38, 39, 40; C.I. Basic Violet 1, 3, 7, 10, 14, 15, 21, 25, 26, 27, 28; C.I. Direct Red 1, 4; C.I. Acid Red 1; and C.I. Mordant Red 30.

Examples of the cyan dyes may include: C.I. Direct Blue 1, C.I. Direct Blue 2, C.I. Acid Blue 9, C.I. Acid Blue 15, C.I. Basic Blue 3, C.I. Basic Blue 5, C.I. Mordant Blue 7, C.I. Direct Green 6, C.I. Basic Green 4, and C.I. Basic Green 6.

These dyes may preferably be used in an amount of 0.1–20 wt. parts, more preferably 0.3–10 wt. parts, per 100 wt. parts of the resin.

The toner according to the present invention can be constituted as a magnetic toner by containing a magnetic material, which may also function as a colorant. Examples of the magnetic material used in the magnetic toner in the present invention may include: iron oxides, such as magnetite, hematite, and ferrite; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten, and vanadium; and mixtures of the above.

The magnetic material may preferably have an average particle size of at most 2 μm, more preferably 0.1–5 μm. The magnetic material may preferably show a coercive force (Hc) of 20–300 Oersted, a saturation magnetization ($\sigma_s$) of 50–200 emu/g, and a residual magnetization ($\sigma_r$) of 2–20 emu/g.

The toner may further contain an additive which may be internally added into toner particles and externally added outside the toner particles. Such an additive may preferably be in the form of particles having a particle size which is at most ⅕ of the volume-average particle size of the toner particles in view of its durability when added internally or externally. The average particle size of an additive refers to an average particle size obtained by observation of surface states of toner particles through an electron microscope. Examples of the additive may include the following.

Flowability imparting agents, such as metal oxides inclusive of silicon oxide, aluminum oxide and titanium oxide, carbon black, and fluorinated carbon. These materials may preferably be subjected to a hydrophobicity-imparting treatment.

Abrasives, inclusive of: metal oxides such as strontium titanate, cerium oxide, aluminum oxide, magnesium oxide, and chromium oxide; nitrides, such as silicon nitride; carbide, such as silicon carbide; and metal salts, such as calcium sulfate, barium sulfate and calcium carbonate.

Lubricants, inclusive of: powder of fluorine-containing resins, such as polyvinylidene fluoride, and polytetrafluoroethylene; and aliphatic acid metal salts, such as zinc stearate, and calcium stearate.

Charge-controlling particles, inclusive of: particles of metal oxides, such as tin oxide, titanium oxide, zinc oxide, silicon oxide, and aluminum oxide, and carbon black.

These additives may be added in a proportion of 0.1–10 wt. parts, preferably 0.1–5 wt. parts, per 100 wt. parts of the toner particles. These additives may be used singly or in combination of plural species.

The toner according to the present invention may be used as a one-component type or a two-component type developer.

For example, a one-component type developer in the form of a magnetic toner containing a magnetic material in toner particles may be conveyed and charged on a developing sleeve containing a magnet therein. A non-magnetic toner free of a magnetic material may be applied and charged forcibly by a blade or a fur brush onto a developing sleeve and conveyed thereby.

Where the toner according to the present invention is used for constituting a two-component type developer, the toner is used together with a carrier. The carrier need not be restricted particularly but may principally comprise a ferrite of elements such as iron, copper, zinc, nickel, cobalt, manganese and chromium, or a composite of such ferrites. The carrier particles may be shaped spherical, flat or irregular in view of the saturation magnetization and electrical resistivity. The surface microscopic structure, such as surface unevenness, of the carrier may also be controlled desirably. Generally, the above-mentioned inorganic oxide or ferrite may be calcined, and formed into core particles, which may be then coated with a resin. However, it is possible to produce a low-density dispersion type carrier by kneading the inorganic oxide and a resin, followed by pulverization and classification, so as to reduce the load of the carrier onto the toner or to produce a true-spherical dispersion carrier by subjecting a mixture of the inorganic oxide and a monomer to suppression polymerization in an aqueous medium.

It is particularly preferred to provide a carrier coated with a resin, etc. The coating may for example be performed by dissolving or dispersing a coating resin in a solvent, followed by attachment onto the carrier, or by powder mixing of the coating resin with the carrier. Any known methods may be applied.

Examples of the coating material firmly applied onto the carrier core particles may include: polytetrafluoroethylene, monochlorotrifluoroethylene polymer, polyvinylidene fluoride, silicone resin, polyester resin, di-tert-butylsalicylic acid metal compound, styrene resin, acrylic resin, polyamide, polyvinyl butyral, nigrosine, aminoacrylate resin, basic dyes and lakes thereof, silica fine powder and alumina fine powder. These coating materials may be used singly or in combination of plural species.

The coating material may be applied onto the core particles in a proportion of 0.1–30 wt. %, preferably 0.5–20 wt. %, based on the carrier core particles. The carrier may preferably have an average particle size of 10–100 μm, more preferably 20–50 μm.

A particularly preferred type of carrier may comprise particles of a magnetic ferrite such as Cu— Zn—Fe ternary ferrite surface–coated with a fluorine-containing resin or a styrene-based resin. Preferred coating materials may include mixtures of a fluorine containing resin and a styrene copolymer, such as a mixture of polyvinylidene fluoride and styrene-methyl methacrylate resin, and a mixture of polytetrafluoroethylene and styrene-methyl methacrylate resin. The fluorine-containing resin may also be a copolymer, such as vinylidene fluoride/tetrafluoroethylene (10/90–90/10) copolymer. Other examples of the styrene- based resin may include styrene/2-ethylhexyl acrylate (20/80–80/20) copolymer and styrene/2-ethylhexyl acrylate/methyl methacrylate (20–60/5–30/10–50) copolymer. The fluorine-containing resin and the styrene-based resin may be blended in a weight ratio of 90:10–20:80, preferably 70:30–30:70. The coating amount may be 0.01–5 wt. %, preferably 0.1– 1 wt. % of the carrier core.

The coated magnetic ferrite carrier may preferably include at least 70 wt. % of particles of 250 mesh-pass and 400 mesh-on, and have an average particle size of 10–100 μm, more preferably 20–70 μm. A sharp particle size distribution is preferred. The above-mentioned coated magnetic ferrite carrier shows a preferable triboelectric charging performance for the toner according to the invention and provides a two-component type developer with improved electro-photographic performances.

The toner according to the invention and a carrier may be blended in such a ratio as to provide a toner concentration of 2–15 wt. %, preferably 4–13 wt. %, whereby good results are obtained ordinarily. At a toner concentration of below 2 wt. %, the image density is liable to be lowered. Above 15 wt. %, the image fog and scattering of toner in the apparatus are increased, and the life of the developer is liable to be shortened.

The carrier may preferably have a magnetization of 1000 Oersted after magnetic saturation ($\sigma_{1000}$) of 30–300 emu/cm$^3$, further preferably 100– 250 emu/cm$^3$, for high quality image formation. In excess of 300 emu/cm$^3$, there is a tendency that it is difficult to obtain high-quality toner images. Below 30 emu/cm$^3$, carrier attachment is liable to occur because of decreased magnetic constraint.

The carrier may preferably satisfy shape factor including an SF1 showing a degree of roundness of at most 180, and an SF2 showing a degree of unevenness of at most 250. SF1 and SF2 may be defined by the following equations and determined based on measured values with respect to carrier particles obtained by using, e.g., "LUZEX 111" available from Nireco K.K.:

$$SF1=((\text{maximum length})^2/\text{area})\times\pi/4$$

$$SF2=((\text{peripheral length})/\text{area})\times 1/4\pi.$$

The toner for developing electrostatic images according to the present invention according to the pulverization process may be produced by sufficiently mixing a binder resin, the ester compound, pigment, dye or a magnetic material as a colorant, and optional additives, such as a charge control agent and others, by means of a mixer such as a Henschel mixer or a ball mill; then melting and kneading the mixture by hot kneading means such as hot rollers, kneader and extruder to disperse or dissolve the resin and others; cooling and pulverizing the mixture; and subjecting the pulverized product to classification to recover the toner of the present invention.

Further, the toner may be sufficiently blended with another desired additive, such as a flowability-improving agent, by a mixer, such as a Henschel mixer to attach the additive to the toner particles, whereby a toner according to the present invention is produced.

The toner according to the present invention may also be produced through a polymerization process in the following manner. Into a polymerizable monomer, the ester compound, a colorant, a charge control agent, a polymerization initiator and another optional additive are added and uniformly dissolved or dispersed by a homogenizer or an ultrasonic dispersing device, to form a polymerizable monomer mixture, which is then dispersed and formed into particles in a dispersion medium containing a dispersion stabilizer or an emulsifier by means of a stirrer, homomixer or homogenizer. Thereafter, the stirring may be continued in such a degree as to retain the particles of the polymerizable monomer mixture thus formed and prevent the sedimentation of the particles. The polymerization may be performed at a temperature of at least 40° C., generally 50°–90° C. The temperature can be raised at a latter stage of the polymerization. It is also possible to subject a part of the aqueous system to distillation in a latter stage of or after the polymerization in order to remove the yet-polymerized part of the polymerizable monomer and a by-product which can cause an odor in the toner fixation step. After the reaction, the produced toner particles are washed, filtered out, and dried. In the suspension polymerization or emulsion polymerization, it is generally preferred to use 300–3000 wt. parts of water as the dispersion medium per 100 wt. parts of the monomer mixture.

The average particle size of a toner may be measured by a Coulter Counter (e.g., "Model TA-II" available from Coulter Electronics Co.). The toner may preferably have a weight–average particle size of 0.1–12 μm and a variation coefficient of 8–40% at the weight-average particle size. The toner may preferably have shape factors including an SF1 showing a roundness of $100<SF1<150$, and an SF2 showing an unevenness of $100<SF2<200$.

In the case of directly producing the toner through the polymerization process, the monomer may be a vinyl-type monomer, examples of which may include: styrene and its derivatives such as styrene, o-methylstyrene, m-methylstyrene, p-methylstyrene, p-methoxystyrene, and p-ethylstyrene; acrylic acid esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; methacrylic acid esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylonitrile, methacrylonitrile, and acrylamide. These monomers may be used singly or in mixture of two or more species.

The polymerizable monomer mixture to be used for toner production through the polymerization process may contain as an additive a polymer or copolymer having a polar group.

Examples of such a polar polymer or copolymer may include: polymers of nitrogen-containing monomers, such as dimethylaminoethyl methacrylate and diethylaminoethyl methacrylate, and copolymers thereof with other monomers such as styrene and unsaturated carboxylic acid esters; polymers of nitrile monomers, such as acrylonitrile, halogen-containing monomers, such as vinyl chloride, unsaturated carboxylic acids, such as acrylic acid and methacrylic acid, unsaturated dibasic acid, unsaturated dibasic acid anhydrides and nitro-type monomers, and copolymers with another monomer, such as styrene; polyester and epoxy resins.

Specific examples of the polymerization initiator usable in the present invention may include: azo- or diazo-type polymerization initiators, such as 2,2'-azobis-(2,4-dimethylvaleronitrile), 2,2'-azobisisobutylonitrile, 1,1'-azobis(cyclohexane-2-carbonitrile), 2,2'-azobis-4-methoxy-2,4-dimethylvaleronitrile, azobisisobutyronitrile; and peroxide-type polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis(4,4-t-butylperoxycyclohexyl)propane, and tris(t-butyl)peroxytriazine, and polymeric initiators having a peroxide group in their side chains; persulfates such as potassium persulfate and ammonium persulfate; and hydrogen peroxide.

The polymerization initiator may generally be in the range of about 0.5–10 wt. % based on the weight of the polymerizable monomer. The polymerization initiators may be used singly or mixture.

In production of the polymerization process toner by emulsion polymerization, dispersion polymerization, suspension polymerization, seed polymerization or polymerization utilizing salting out, it is preferred to use a dispersion stabilizer in the dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, polyacrylic acid and its salt, starch, polyacrylamide, polyethylene oxide, hydroxystearic acid-g-methyl methacrylate-eu-methacrylic acid copolymer, and nonionic or ionic surfactants.

In emulsion polymerization, there may be used artionic surfactant, cationic surfactant, amphoteric surfactant or nonionic surfactant. These dispersion stabilizers may preferably be used in an amount of 0.2– 30 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof.

In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium stearate.

Regarding the colorant to be used for toner production by polymerization, it is necessary to pay attention to the polymerization-inhibiting function and transferability to the aqueous phase of the colorant. Accordingly, it is preferred to use the above-mentioned colorant after surface modification. For example, it is appropriate to hydrophobise the colorant so as not to inhibit the polymerization. Particularly, many dyes and carbon black can inhibit the polymerization, so that attention should be paid. As a preferred method of surface-treating a dye, a monomer may be polymerized in advance in the presence of the dye. The resultant colored polymer may be added to the polymerizable monomer mixture. Carbon black can be treated in the same manner as the dye and can also be treated with a substance capable of reacting with the surface-functional group of the carbon black, such as polyorganosiloxane.

The fixability, anti-offset characteristic, color mixing range and transparency of a toner may be evaluated in the following manner.

1) Fixability, Anti-offset characteristic and Color-mixing range:

To a toner containing an ester compound, an appropriate amount of external additive is added to provide a developer. The developer is used in a commercially available copier to form yet-unfixed images.

If the toner is a black toner, the unfixed toner images are subjected to fixation by an external hot roller fixing device equipped with no oil application, thereby evaluating the fixability and anti-offset characteristic of the toner.

If the toner is a color toner for providing monochromatic or full–color images, the unfixed images are subjected to fixation by an external hot roller fixing device equipped with no oil applicator, or fixation by the fixing device of a commercially available full-color copier ("CLC-5000" available from Canon K.K.) while applying a small amount of oil (e.g., 0.02 g/A4-size) onto a fixing roller, thereby evaluating the fixability, anti-offset characteristic and color-mixing range and also obtaining a fixed toner image for evaluation of the transparency.

The fixing rollers comprise a fluorine-containing resin or rubber The fixing conditions include a nip of 6.0mm and a process speed of 90 mm/sec for fixation on plain paper ("SK paper, mfd. by Nippon Seishi K.K.), and a nip of 6.0 mm and a process speed of 20 mm/sec for fixation on an OHP sheet ("Pictorico Trapen" for copier, mfd by Asahi Glass K.K.) The fixation test is performed in the temperature range of 80°–230° C. under temperature control while changing the temperature at an increment of 5° C. each.

The fixability is evaluated by rubbing a fixed toner image (in a sense of including an image having caused low-temperature offset) with a lens cleaning paper ("Dasper (R)", mfd. by Ozu Paper, Co., Ltd.) at a load of 50 g/cm$^2$ and the fixability is evaluated in terms of a fixing initiation temperature $T_{FI}$ (°C.) at or above which the density decrease of the image after the rubbing is below 10%.

The anti-offset characteristic is evaluated in terms a lower limit temperature (lower offset initiation temperature) at or above which offset is unobservable and a higher limit temperature (higher offset terminating temperature) at or below which offset is unobservable respectively by eye observation.

The color-mixing range is evaluated by measuring the gloss of the fixed images obtained in the non-offset region by a handy gloss checker ("IG-310", mfd. by Horiba Seisakusho K.K.) and evaluated in terms of the range between the lower limit temperature and the higher limit temperature, wherein the gloss value is 7 or higher.

2) Transparency

The transmittance and haze are measured with respect to fixed toner images at varying toner weights per unit area, and the transparency is evaluated by the transmittance Tp [%] and haze [–] at a toner weight per unit area of 0.75 mg/cm$^2$. The transmittance Tp [%] and haze Hz [–] may be measured in the following manner.

The transmittance Tp [%] of an OHP image is measured relative to that of an OHP sheet per se as Tp =100% by using an auto-recording spectrophotometer at maximum absorption wavelengths for the respective toners (i.e., 650 nm for a magenta toner, 500 nm for a cyan toner, and 600 nm for a yellow toner).

The haze [–] may be measured by using a haze meter ("NDH-300A", mfd. by Nippon Hasshoku Kogyo K.K.).

Other parameters characterizing a toner or toner ingredients referred to herein are those measured in the following manner.

The heat-absorption and heat-revolution characteristics of an ester compound may be evaluated by DSC measurement by using a high-accuracy, internal-heating and input-compensation type DSC (differential scanning calorimeter) (e.g., "DSC-7", mfd. by Perkin-Elmer Corp.). The measurement may be performed according to ASTM D3418-82. A DSC curve may appropriately be taken in the courses of temperature lowering and temperature raising, respectively at a temperature-changing rate of 10° C./min., after once heating a sample so as to remove the hysteresis.

FT-IR measurement may be performed according to the KBr method by using, e.g., "FTS 60A" (mfd. by Biorad Co.).

NMR measurement may be performed using, e.g., "EX-400" (mfd. by Nippon Denshi K.K.) at 400 MHz.

Some synthesis examples of ester compounds used in the present invention are described below.

1) Synthesis of poly-functional ester A-1

Figure 2:
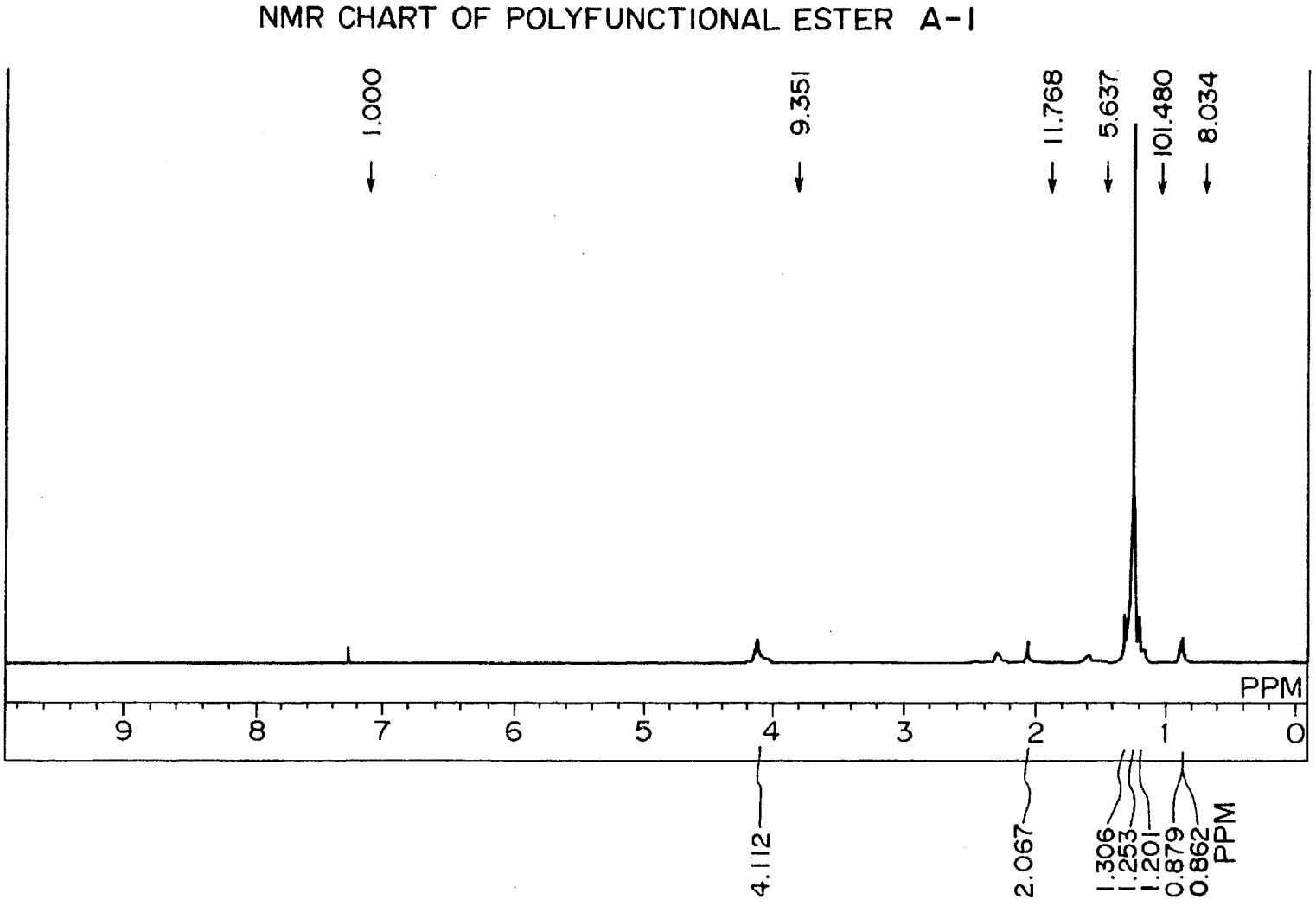
FIG. 2 is an NMR (nuclear magnetic resonance) chart of poly-functional ester A-1.

In a 3 liter-four-necked flask equipped with a Dimroth reflux condenser and Dean-Stark water separator, 2 liter of benzene, 210 g of acetic acid, 1200 g of behenic acid, 200 g of pentaerythritol and p-toluenesulfonic acid (0.5 g) were placed and sufficiently stirred for dissolution, followed by 7 hours of refluxing and then azeotropic distilling-off by opening the valve of the water separator. Thereafter, the contents were sufficiently washed with sodium bicarbonate, dried and subjected to distilling-off of the solvent. The product was recrystallized, washed and purified. The purified product was subjected product was subjected to IR and NMR analysis for identification of the structure. The IR spectrum chart is shown as FIG. 1 attached hereto. The NMR spectrum chart (FIG. 2) showed peaks at 0.8, 1.25, 1.6, 2.1, 2.3 and 4.1 ppm. From these results and also obtained H—H cosy spectrum and $^{13}$C-NMR spectrum, the production of poly-functional ester A-1 having a structure shown hereinbefore is suggested. The poly-functional ester A-1 provided the following properties:

DSC peak: at 60° C.

(ΔH); 121 J/g

Refractive index: 1.47

SP value: 9.1

Hardness: 2.8

Crystallinity: 34%

Viscosity: 18 cps

Number-average molecular weight (Mn): 900

Melting point (Tmp): 73° C.

2) Synthesis of poly-functional ester A-2

In a 3 liter-four-necked flask equipped with a Dimroth reflux condenser and a Dean-Stark water separator, 2 liter of benzene, 210 g of acetic acid, 1000 g of stearic acid, 200 g of pentaerythritol and p-toluenesulfonic acid were placed and sufficiently stirred for dissolution, followed by 6 hours of refluxing. The procedure thereafter was identical to that in 1) Synthesis of poly-functional ester A-1 described above. The thus–synthesized poly-functional ester A-2 showed the following properties:

DSC peak: at 45° C.

(ΔH): 98 J/g

Refractive index: 1.47

SP value: 9.2

Hardness: 2.4

Crystallinity: 20%

Viscosity: 12 cps

Mn: 800

Tmp: 50° C.

3) Synthesis of poly-functional ester A-3

In a 3 liter-four-necked flask equipped with a Dimroth reflux condenser and a Dean-Stark water separator, 2 liter of benzene, 300 g of trifluoroacetic acid, 1200 g of behenic acid, 200 g of pentaerythritol and p-toluenesulfonic acid were placed and sufficiently stirred for dissolution, followed by 7 hours of refluxing. The procedure thereafter was identical to that in 1) Synthesis of poly-functional ester A-1 described above. The thus-synthesized poly-functional ester A-3 showed the following properties:

DSC peak: at 58° C.

(ΔH): 111 J/g

Refractive index: 1.46

SP value: 8.8

Hardness: 2.7

Crystallinity: 28%

Viscosity: 16 cps

Mn: 950

Tmp: 70° C.

4) Synthesis of poly-functional ester A-4

In a 3 liter-four-necked flask equipped with a Dimroth reflux condenser and a Dean-Stark water separator, 2 liter of benzene, 300 g of trifluoroacetic acid, 1000 g of stearic acid, 200 g of pentaerythritol and p-toluenesulfonic acid were placed and sufficiently stirred for dissolution, followed by 6 hours of refluxing. The procedure thereafter was identical to that in 1) Synthesis of poly-functional ester A-1 described above. The thus-synthesized poly-functional ester A-4 showed the following properties:

DSC peak: at 53° C.

(ΔH); 102 J/g

Refractive index: 1.48

SP value: 8.9

Hardness: 1.8

Crystallinity: 28%

Viscosity: 18 cps

Mn: 840

Tmp: 64° C.

5) Synthesis of poly-functional ester A-13

In a 3 liter-four-necked flask equipped with a Dimroth reflux condenser and a Dean-Stark water separator, 2 liter of benzene, 1300 g of stearic acid, 200 g of neopentyl glycol and p-toluenesulfonic acid were placed and sufficiently stirred for dissolution, followed by 5 hours of refluxing. The procedure thereafter was identical to that in 1) Synthesis of poly-functional ester A-1 described above. The thus-synthesized poly-functional ester A-13 showed the following properties:

DSC peak: at 31° C.

(ΔH): 106 J/g

Refractive index: 1.47

SP value: 8.8

Hardness: 1.8

Crystallinity: 26%

Viscosity: 7 cps

Mn: 705

Tmp: 40° C.

6) Synthesis of poly-functional ester A-15

In a 3 liter-four-necked flask equipped with a Dimroth reflux condenser and a Dean-Stark water separator, 2 liter of benzene, 750 g of behenic acid, 200 g of 2-butyl-2-ethyl-1, 3-propanediol and p-toluenesulfonic acid were placed and sufficiently stirred for dissolution, followed by 5 hours of refluxing. The procedure thereafter was identical to that in 1) Synthesis of poly-functional ester A-1 described above. The thus–synthesized poly-functional ester A-15 showed the following properties:

DSC peak: at 46° C.

(ΔH): 109 J/g

Refractive index: 1.48

SP value: 8.7

Hardness: 2.6

Crystallinity: 30%

Viscosity: 33 cps

Mn: 615

Tmp: 50° C.

7) Synthesis of poly-functional ester A-21

In a 3 liter-four-necked flask equipped with a Dimroth reflux condenser and a Dean-Stark water separator, 2 liter of benzene, 630 g of phthalic acid, 500 g of cetyl alcohol and p-toluenesulfonic acid were placed and sufficiently stirred for dissolution, followed by 5 hours of refluxing. The procedure thereafter was identical to that in 1) Synthesis of poly-functional ester A-1 described above. The thus-synthesized poly-functional ester A-21 showed the following properties:

DSC peak: at 49° C.

(ΔH); 130 J/g

Refractive index: 1.48

SP value: 9.6

Hardness: 3.4

Crystallinity: 21%

Viscosity: 6 cps

Mn: 645

Tmp; 50° C.

8) Synthesis of mono-functional ester B1

In a 4 liter-four-necked flask equipped with a Dimroth reflux condenser and Dean-Stark water separator, 2 liter of benzene, 720 g of montanic acid, 200 g of 2,2-dimethyloctanol and p-toluenesulfonic acid were placed and sufficiently stirred for dissolution, followed by 7 hours of refluxing and then azeotropic distilling-off by opening the valve of the water separator, Thereafter, the contents were sufficiently washed with sodium bicarbonate, dried and subjected to distilling-off of the solvent. The product was recrystallized, washed and purified. The thus obtained mono-functional ester B-1 provided the following properties:

DSC peak: at 61° C.

(ΔH): 115 J/g

Refractive index: 1.48

SP value: 8.1

Hardness: 2.8

Crystallinity: 20%

Viscosity: 13 cps

Mn (VPO method): 535

Tmp; 74° C.

The molecular weight distribution of the mono-functional ester B-1 was measured according to HPLC (high performance liquid chromatography) in the following manner. A sample solution was obtained by dissolving the mono-functional ester at a concentration of 1.0% in chloroform. Separately, solvent chloroform was passed through a combination of plural polystyrene gel columns (e.g., "JAIGEL 1H" and "JAIGEL 2H" available from Nippon Bunseki Kogyo K.K.) at a rate of 3.5 ml/min., and then about 3.5 ml of the sample solution was injected for HPLC by using an RI (refractive index) detector.

The thus obtained HPLC chromatogram of the monofunctional ester compound was very sharp, thus indicating a high purity, while natural wax and synthetic wax conventionally used provided broad chromatograms even if they were subjected to HPLC after distillation.

9) Synthesis of mono-functional ester B-2

In a 4 liter-four-necked flask equipped with a Dimroth reflux condenser and a Dean-Stark water separator 2 liter of benzene 530 g of behenic acid 200 g of 2,2-diethylheptanol and p-toluenesulfonic acid were placed and sufficiently stirred for dissolution, followed by 6 hours of refluxing. The procedure thereafter was identical to that in 8) Synthesis of mono-functional ester B-1 described above. The thus-synthesized mono-functional ester B-2 showed the following properties:

DSC peak: at 59° C.

(ΔH): 109 J/g

Refractive index: 1.48

SP value: 8.4

Hardness: 1.9

Crystallinity: 29%

Viscosity: 17 cps

Mn (VPO method): 530

Tmp: 71° C.

10) Synthesis of mono-functional ester B-3

In a 4 liter-four-necked flask equipped with a Dimroth reflux condenser and a Dean-Stark water separator 2 liter of benzene 540 g of stearic acid 200 g of 4-ethylheptanol and p-toluenesulfonic acid were placed and sufficiently stirred for dissolution, followed by 7 hours of refluxing. The procedure thereafter was identical to that in 8) Synthesis of mono-functional ester B-1 described above. The thus-synthesized mono-functional ester B-3 showed the following properties:

DSC peak: at 62° C.

(ΔH): 122 J/g

Refractive index: 1.48

SP value: 9.2

Hardness: 2.2

Crystallinity: 31%

Viscosity: 18 cps

Mn (VPO method): 450

Tmp: 75° C.

11) Synthesis of mono-functional ester B-4

In a 4 liter-four-necked flask equipped with a Dimroth reflux condenser and a Dean-Stark water separator, 2 liter of benzene, 580 g of behenic acid, 200 g of 6-propylheptanol and p-toluenesulfonic acid were placed and sufficiently stirred for dissolution, followed by 6 hours of refluxing. The procedure thereafter was identical to that in 8) Synthesis of mono-functional ester B-1 described above. The thus-synthesized mono-functional ester B-4 showed the following properties:

DSC peak: at 55° C.

(ΔH): 111 J/g

Refractive index: 1.49

SP value: 8.5

Hardness: 2.7

Crystallinity: 36%

Viscosity: 22 cps

Mn (VPO method): 510

Tmp: 66° C.

12) Synthesis of poly-functional ester C-1

In a 4 liter-four-necked flask equipped with a Dimroth reflux condenser and Dean-Stark water separator, 2 liter of benzene, 220 g of trifluoroacetic acid, 1700 g of behenic acid, 200 g of glycerol and p-toluenesulfonic acid were placed and sufficiently stirred for dissolution, followed by 7 hours of refluxing and then azeotropic distilling-off by opening the valve of the water separator. Thereafter, the contents were sufficiently washed with sodium bicarbonate, dried and subjected to distilling-off of the solvent. The product was recrystallized, washed and purified. The thus-obtained poly-functional ester C-1 provided the following properties:

DSC peak: at 61° C.

(ΔH): 112 J/g

Refractive index: 1.48

SP value: 8.8

Hardness: 2.8

Crystallinity: 20%

Viscosity: 12 cps

Mn: 840

Tmp: 72° C.

13) Synthesis of poly-functional ester C-2

In a 4 liter-four-necked flask equipped with a Dimroth reflux condenser and a Dean-Stark water separator, 2 liter of benzene, 110 g of acetic acid, 1200 g of behenic acid, 200 g of 1,2,6-hexanetriol and p-toluenesulfonic acid were placed and sufficiently stirred for dissolution, followed by 6 hours of refluxing. The procedure thereafter was identical to that in 12) Synthesis of poly-functional ester C-1 described above. The thus-synthesized poly-functional ester C-2 showed the following properties:

DSC peak: at 55° C.

(ΔH); 108 J/g

Refractive index: 1.49

SP value: 8.9

Hardness: 1.9

Crystallinity: 25%

Viscosity: 12 cps

Mn: 850

Tmp: 63° C.

14) Synthesis of poly-functional ester C-3

In a 4 liter-four-necked flask equipped with a Dimroth reflux condenser and a Dean-Stark water separator, 2 liter of benzene, 1750 g of montanic acid, 200 g of 1,4-cyclohexanediol and p-toluenesulfonic acid were placed and sufficiently stirred for dissolution, followed by 7 hours of refluxing. The procedure thereafter was identical to that in 12) Synthesis of poly-functional ester C-1 described above. The thus-synthesized poly-functional ester C-3 showed the following properties:

DSC peak: at 64° C.

(ΔH): 125 J/g

Refractive index: 1.47

SP value: 8.7

Hardness: 3.4

Crystallinity: 28%

Viscosity: 15 cps

Mn: 950

Tmp: 77° C.

15) Synthesis of poly-functional ester C-4

In a 4 liter-four-necked flask equipped with a Dimroth reflux condenser and a Dean-Stark water separator, 2 liter of benzene, 1750 g of montanic acid, 200 g of 1,2-cyclohexanediol and p-toluenesulfonic acid were placed and sufficiently stirred for dissolution, followed by 7 hours of refluxing. The procedure thereafter was identical to that in 12) Synthesis of poly-functional ester C-1 described above. The thus-synthesized poly-functional ester C-4 showed the following properties:

DSC peak: at 58° C.

(ΔH); 101 J/g

Refractive index: 1.50

SP value: 8.7

Hardness: 1.8

Crystallinity: 36%

Viscosity: 33 cps

Mn: 950

Tmp: 69° C.

Hereinbelow, Examples and Comparative Examples of toner production and evaluation are described.

EXAMPLE 1

| | |
|---|---|
| Styrene-butyl acrylate/divinylbenzene (80/16/4 by weight) copolymer (Mw (weight-average molecular weight) = ca. $5 \times 10^4$; RI (refractive index at 25° C.) = 1.57) | 1000 wt. parts |
| Magnetic iron oxide (Dav (average particle size) = 0.25 μm) (Ms (saturation magnetization) = 60 emu/g) (Mr (residual magnetization) = 10 emu/g) Hc (coercive force) = 120 oersted, respectively measured at or after magnetization at 10 kilo-oersted) | 800 wt. parts |
| Di-t-butylsalicylic acid metal compound | 20 wt. parts |
| Polyfunctional ester A-1 | 40 wt. parts |

The above ingredients were preliminarily blended and then melt-kneaded through a twin-screw kneading extruder. After cooling, the kneaded product was coarsely crushed and finely pulverized by a pulverizer utilizing a jet air stream, followed by classification by a pneumatic classifier to obtain a magnetic toner having a weight-average particle size of 8.2 μm. The magnetic toner in 100 wt. parts was blended with 0.7 wt. part of hydrophobic colloidal silica fine powder externally added thereto to obtain a magnetic toner comprising toner particles carrying colloidal silica fine powder on the surface thereof.

The magnetic toner was charged in a commercially available electro-photographic copier ("NP-8582", available from Canon K.K.) to form yet unfixed toner images, which were then subjected to evaluation of fixability and anti-offset characteristic in the manners described hereinbefore.

The results are summarized in Table 1 appearing hereinafter.

EXAMPLE 2

| | |
|---|---|
| Styrene/butyl acrylate/divinylbenzene (80/16/4) copolymer (Mw = ca. $5 \times 10^4$) | 1000 wt. parts |
| Magnetic iron oxide (Dav. = 0.25 μm, Ms = 60 emu/g, Mr = 10 emu/g, Hc = 120 oersted) | 800 wt. parts |
| Di-t-butylsalicylic acid metal compound | 20 wt. parts |
| Polyfunctional ester A-3 | 40 wt. parts |

A magnetic toner was prepared and evaluated in the same manner as in Example 1 except for the use of the above ingredients. The magnetic toner (substantially excluding the hydrophobic colloidal silica fine powder) showed a weight-average particle size of 8.1 μm.

The results are also shown in Table 1 appearing hereinafter.

Example 3

| | |
|---|---|
| Styrene/butyl acrylate/divinylbenzene (80/16/4) copolymer (Mw = ca. $5 \times 10^4$) | 1000 wt. parts |
| Magnetic iron oxide (Dav. = 0.25 μm, Ms = 60 emu/g, Mr = 10 emu/g, Hc = 120 oersted) | 800 wt. parts |
| Di-t-butylsalicylic acid metal compound | 20 wt. parts |
| Polyfunctional ester A-6 | 40 wt. parts |

A magnetic toner was prepared and evaluated in the same manner as in Example 1 except for the use of the above ingredients. The magnetic toner (substantially excluding the hydrophobic colloidal silica fine powder) showed a weight-average particle size of 8.2 μm.

The results are also shown in Table 1 appearing hereinafter.

EXAMPLE 4

| | |
|---|---|
| Styrene/butyl acrylate/divinylbenzene (80/16/4) copolymer (Mw = ca. $5 \times 10^4$) | 1000 wt. parts |
| Magnetic iron oxide (Dav. = 0.25 μm, Ms = 60 emu/g, Mr = 10 emu/g, Hc = 120 oersted) | 800 wt. parts |
| Di-t-butylsalicylic acid metal compound | 20 wt. parts |
| Polyfunctional ester A-5 | 40 wt. parts |

A magnetic toner was prepared and evaluated in the same manner as in Example 1 except for the use of the above ingredients. The magnetic toner (substantially excluding the hydrophobic colloidal silica fine powder) showed a weight-average particle size of 8.1 μm.

The results are also shown in Table 1 appearing hereinafter.

EXAMPLE 5

| | |
|---|---|
| Polyester resin (bisphenol A-type diol/terephthalic acid/trimellitic acid (50/40/10) condensate) (Mw = ca. $5.5 \times 10^4$, RI = 1.49) | 1000 wt. parts |
| Magnetic iron oxide (Dav. = 0.25 μm, Ms = 60 emu/g, Mr = 10 emu/g, Hc = 120 oersted) | 750 wt. parts |
| Monoazo metal compound | 20 wt. parts |
| Polyfunctional ester A-4 | 40 wt. parts |

A magnetic toner was prepared and evaluated in the same manner as in Example 1 except for the use of the above ingredients. The magnetic toner (substantially excluding the hydrophobic colloidal silica fine powder) showed a weight-average particle size of 8.1 μm.

The results are also shown in Table 1 appearing hereinafter.

EXAMPLE 6

| | |
|---|---|
| Polyester resin (bisphenol A-type diol/terephthalic acid/trimellitic acid (50/40/10) condensate) (Mw = ca. $5.5 \times 10^4$, RI = 1.49) | 1000 wt. parts |
| Magnetic iron oxide (Dav. = 0.25 μm, Ms = 60 emu/g, Mr = 10 emu/g, Hc = 120 oersted) | 750 wt. parts |
| Monoazo metal compound | 20 wt. parts |
| Polyfunctional ester A-2 | 40 wt. parts |

A magnetic toner was prepared and evaluated in the same manner as in Example 1 except for the use of the above ingredients. The magnetic toner (substantially excluding the hydrophobic colloidal silica fine powder) showed a weight-average particle size of 8.1 μm.

The results are also shown in Table 1 appearing hereinafter.

EXAMPLE 7

| | |
|---|---|
| Polyester resin (bisphenol A-type diol/terephthalic acid/trimellitic acid (50/40/10) condensate) (Mw = ca. $5.5 \times 10^4$, RI = 1.49) | 1000 wt. parts |
| Magnetic iron oxide (Dav. = 0.25 μm, Ms = 60 emu/g, Mr = 10 emu/g, Hc = 120 oersted) | 750 wt. parts |
| Monoazo metal compound | 20 wt. parts |
| Polyfunctional ester A-7 | 40 wt. parts |

A magnetic toner was prepared and evaluated in the same manner as in Example 1 except for the use of the above ingredients. The magnetic toner (substantially excluding the hydrophobic colloidal silica fine powder) showed a weight-average particle size of 8.0 μm.

The results are also shown in Table 1 appearing hereinafter.

EXAMPLE 8

| | |
|---|---|
| Polyester resin (bisphenol A-type diol/terephthalic acid/trimellitic acid (50/45/5) condensate) (Mw = ca. $5.5 \times 10^4$, RI = 1.50) | 1000 wt. parts |
| Copper-phthalocyanine pigment | 40 wt. parts |
| Monoazo metal compound | 20 wt. parts |
| Polyfunctional ester A-1 | 40 wt. parts |

A cyan color toner having a weight-average particle size of 7.8 μm was prepared in the same manner as in Example 1 except for the use of the above ingredients. The toner in 100 wt. parts was blended with 1.2 wt. parts of hydrophobic titanium oxide fine powder externally added thereto to obtain a cyan color toner comprising toner particles carrying the titanium oxide fine powder attached onto the surfaces thereof.

6 wt. parts of the cyan toner was blended with 94 wt. parts of a ferrite carrier coated with acrylic resin to obtain a two-component type developer.

The developer was charged in a commercially available color copier ("CLC 500", available from Canon K.K.) to form yet un-fixed images, which were then subjected to evaluation of fixability, anti-offset characteristic, color-mixing range and transparency and haze of OHP films obtained thereby, in the manners described hereinbefore.

The results are also shown in Table 1 appearing hereinafter.

EXAMPLE 9

450 wt. parts of 0.1M-$Na_3PO_4$ aqueous solution was added to 710 wt. parts of deionized water, and the mixture was warmed at 60° C. and stirred at 1200 rpm by a TK-type homomixer (available from Tokushu Kika Kogyo K.K.), followed by gradual addition of 68 wt. parts of 1.0M-$CaCl_2$ aqueous solution, to obtain an aqueous medium containing $Ca_3(PO_4)_2$. Separately, the following materials for providing a polymerizable monomer mixture were provided:

| | |
|---|---|
| Styrene monomer | 165 wt. parts |
| n-Butyl acrylate monomer | 35 wt. parts |
| Magnetic iron oxide (Dav. = 0.25 μm, Ms = 60 emu/g, Mr = 10 emu/g, Hc = 120 oersted) | 95 wt. parts |
| Styrene/methacrylic acid/methyl methacrylate (85/5/10) copolymer (Mw = ca. $5.7 \times 10^4$) | 9 wt. parts |
| Divinylbenzene | 2 wt. parts |
| Di-t-butylsalicylic acid metal compound | 2 wt. parts |
| Polyfunctional ester A-1 | 40 wt. parts |

The above materials were warmed at 60° C. and stirred at 12000 rpm by a TK-type homomixer to effect uniform dissolution and dispersion. In the mixture, 10 wt. parts of 2,2'-azobis(2,4-dimethylvaleronitrile) as a polymerization initiator was dissolved, to form a polymerizable monomer mixture. The monomer mixture was then charged into the above-prepared aqueous medium and was formed into particles by stirring for 20 min. at 10000 rpm by a TK-type homomixer at 60° C. in an $N_2$ environment. Thereafter, the system was stirred by a paddle stirrer and heated at 80° C. to effect 10 hours of reaction.

After the reaction, the system was cooled, and hydrochloric acid was added thereto to dissolve the calcium phosphate, followed by filtration, washing with water and drying to obtain polymerizate particles.

To 100 wt. parts of the polymerizate particles, 0.8 wt. part of hydrophobic silica fine powder (BET specific surface area=200 $m^2/g$) was added to obtain a magnetic toner. The magnetic toner showed a weight-average particle size of 8.0 μm (substantially excluding the silica fine powder).

The magnetic toner was evaluated in the same manner as in Example 1 . The results are also shown in Table 1.

EXAMPLE 10

| | |
|---|---|
| Styrene | 165 wt. parts |
| n-Butyl acrylate | 35 wt. parts |
| Copper-phthalocyanine pigment | 14 wt. parts |
| Styrene/methacrylic acid/methyl methacrylate (85/5/10) copolymer (Mw = ca. $5.7 \times 10^4$) | 9 wt. parts |
| Monoazo metal compound | 2 wt. parts |
| Polyfunctional ester A-1 | 40 wt. parts |

A color toner having a weight-average particle size of 8.1 μm was prepared in the same manner as in Example 9 except for the use of the above polymerizable mixture composition. Hydrophobic titanium oxide fine powder in 1.2 wt. parts was externally added to 100 wt. parts of the toner to obtain a color toner comprising toner particles carrying the titanium oxide fine powder attached to the surfaces thereof.

6 wt. parts of the color toner was blended with 94 wt. parts of a ferrite carrier coated with acrylic resin to obtain a two-component type developer.

The developer was charged in a commercially available color copier ("CLC 500", available from Canon K.K.) to form yet un-fixed images, which were then subjected to evaluation of fixability, anti-offset characteristic, color-mixing range and transparency and haze of OHP films obtained thereby, in the manners described hereinbefore.

The results are also shown in Table 1 appearing hereinafter.

EXAMPLE 11

| | |
|---|---|
| Styrene | 165 wt. parts |
| n-Butyl acrylate | 35 wt. parts |
| Copper-phthalocyanine pigment | 14 wt. parts |
| Styrene/methacrylic acid/methyl methacrylate (85/5/10) copolymer (Mw = ca. $5.7 \times 10^4$) | 9 wt. parts |
| Monoazo metal compound | 2 wt. parts |
| Polyfunctional ester A-1 | 20 wt. parts |

A color toner having a weight-average particle size of 7.9 μm was prepared and evaluated in the same manner as in Example 10 except for the use of the above polymerizable mixture composition.

The results are also shown in Table 1.

EXAMPLE 12

| | |
|---|---|
| Styrene | 165 wt. parts |
| n-Butyl acrylate | 35 wt. parts |
| Quinacridone pigment | 16 wt. parts |
| Styrene/methacrylic acid/methyl methacrylate (85/5/10) copolymer (Mw = ca. $5.7 \times 10^4$) | 9 wt. parts |
| Monoazo metal compound | 2 wt. parts |
| Polyfunctional ester A-1 | 20 wt. parts |

A magenta color toner having a weight-average particle size of 7.7 μm was prepared and evaluated in the same manner as in Example 10 except for the use of the above polymerizable mixture composition.

The results are also shown in Table 1.

EXAMPLE 13

| | |
|---|---|
| Styrene | 165 wt. parts |
| n-Butyl acrylate | 35 wt. parts |
| Disazo yellow pigment | 13 wt. parts |
| Styrene/methacrylic acid/methyl methacrylate (85/5/10) copolymer (Mw = ca. $5.7 \times 10^4$) | 9 wt. parts |
| Monoazo metal compound | 2 wt. parts |
| Polyfunctional ester A-1 | 20 wt. parts |

A yellow color toner having a weight-average particle size of 7.8 μm was prepared and evaluated in the same manner as in Example 10 except for the use of the above polymerizable mixture composition.

The results are also shown in Table 1.

Comparative Example 1

| | |
|---|---|
| Styrene/butyl acrylate/divinylbenzene (80/16/4) copolymer (Mw = ca. $5 \times 10^4$) | 1000 wt. parts |
| Magnetic iron oxide (Dav. = 0.25 μm, Ms = 60 emu/g, Mr = 10 emu/g, Hc = 120 oersted) | 800 wt. parts |
| Di-t-butylsalicylic acid metal compound | 20 wt. parts |
| Low-molecular weight polypropylene ("Viscol 660P", available from Sanyo Kasei K.K.) | 40 wt. parts |

A magnetic toner was prepared and evaluated in the same manner as in Example 1 except for the use of the above ingredients. The magnetic toner (substantially excluding the hydrophobic colloidal silica fine powder) showed a weight-average particle size of 8.1 μm.

The results are shown in Table 2 appearing hereinafter.

Comparative Example 2

| | |
|---|---|
| Polyester resin (bisphenol A-type diol/terephthalic acid/trimellitic acid (50/40/10) condensate) (Mw = ca. $5.5 \times 10^4$, RI = 1.49) | 1000 wt. parts |
| Magnetic iron oxide (Dav. = 0.25 μm, Ms = 60 emu/g, Mr = 10 emu/g, Hc = 120 oersted) | 750 wt. parts |
| Monoazo metal compound | 20 wt. parts |
| Montan-type Ester Wax E (available from Hoechst A.G.) | 40 wt. parts |

A magnetic toner was prepared and evaluated in the same manner as in Example 1 except for the use of the above ingredients. The magnetic toner (substantially excluding the hydrophobic colloidal silica fine powder) showed a weight-average particle size of 8.2 μm.

The results are also shown in Table 1 appearing hereinafter.

Comparative Example 3

| | |
|---|---|
| Polyester resin (bisphenol A-type diol/terephthalic acid/trimellitic acid (50/45/5) condensate) (Mw = ca. $5.5 \times 10^4$) | 1000 wt. parts |
| Phthalocyanine pigment (Dav. = 0.25 μm, Ms = 60 emu/g, Mr = 10 emu/g, Hc = 120 oersted) | 40 wt. parts |
| Monoazo metal compound | 20 wt. parts |
| Montan-type Ester Wax KP (available from Hoechst A.G.) | 40 wt. parts |

A cyan toner (having a weight-average particle size of 7.9 μm) was prepared from the above ingredients otherwise in the same manner as in Example 8, and a developer was prepared from the color toner and evaluated in the same manner as in Example 8.

The results are also shown in Table 2 appearing hereinafter.

Comparative Example 4

| | |
|---|---|
| Styrene monomer | 165 wt. parts |
| n-Butyl acrylate monomer | 35 wt. parts |
| Magnetic iron oxide (Dav. = 0.25 μm, Ms = 60 emu/g, Mr = 10 emu/g, Hc = 120 oersted) | 95 wt. parts |
| Styrene/methacrylic acid/methyl methacrylate (85/5/10) copolymer (Mw = ca. $5.7 \times 10^4$) | 9 wt. parts |
| Divinylbenzene | 2 wt. parts |
| Di-t-butylsalicylic acid metal compound | 2 wt. parts |
| Montan-type Ester Wax KP (available from Hoechst A.G.) | 40 wt. parts |

A magnetic toner having a weight-average particle size of 8.2 μm was prepared and evaluated in the same manner as in Example 9 except for the use of the above polymerizable mixture composition.

The results are also shown in Table 2.

Comparative Example 5

| | |
|---|---|
| Styrene | 165 wt. parts |
| n-Butyl acrylate | 35 wt. parts |
| Copper-phthalocyanine pigment | 14 wt. parts |
| Styrene/methacrylic acid/methyl methacrylate (85/5/10) copolymer (Mw = ca. $5.7 \times 10^4$) | 9 wt. parts |
| Monoazo metal compound | 2 wt. parts |

A color toner having a weight-average particle size of 7.9 μm was prepared and evaluated in the same manner as in Example 10 except for the use of the above polymerizable mixture composition.

The results are also shown in Table 2.

Comparative Example 6

| | |
|---|---|
| Styrene | 165 wt. parts |
| n-Butyl acrylate | 35 wt. parts |
| Copper-phthalocyanine pigment | 14 wt. parts |
| Styrene/methacrylic acid/methyl methacrylate (85/5/10) copolymer (Mw = ca. $5.7 \times 10^4$) | 9 wt. parts |
| Monoazo metal compound | 2 wt. parts |

-continued

| | |
|---|---|
| Montan-type Ester Wax E (available from Hoechst A.G.) | 40 wt. parts |

A color toner having a weight-average particle size of 8.0 μm was prepared and evaluated in the same manner as in Example 10 except for the use of the above polymerizable mixture composition.

The results are also shown in Table 2.

The above ingredients were preliminarily blended and then melt-kneaded through a twin-screw kneading extruder. After cooling, the kneaded product was coarsely crushed and finely pulverized by a pulverizer utilizing a jet air stream, followed by classification by a pneumatic classifier to obtain a magnetic toner having a weight-average particle size of 8.1 μm. The magnetic toner in 100 wt. parts was blended with 0.7 wt. part of hydrophobic colloidal silica fine powder externally added thereto to obtain a magnetic toner comprising toner particles carrying colloidal silica fine powder on the surface thereof.

TABLE 1

| | | Anti-offset characteristic | | | Color-mixing range | | | | | |
|---|---|---|---|---|---|---|---|---|---|---|
| | | Lower | Higher | Non-offset | Lower | Higher | | Transparency | | Fixing mode |
| Example | Fixability $T_{FI}$ (°C.) | limit (°C.) | limit (°C.) | range (°C.) | limit (°C.) | limit (°C.) | Range (°C.) | Tp (%) | Haze (—) | with oil or no oil |
| Ex. 1 | 150 | 130 | 210 | 80 | — | — | — | — | — | no oil |
| 2 | 150 | 130 | 205 | 75 | — | — | — | — | — | no oil |
| 3 | 150 | 135 | 200 | 65 | — | — | — | — | — | no oil |
| 4 | 155 | 135 | 200 | 65 | — | — | — | — | — | no oil |
| 5 | 155 | 135 | 195 | 60 | — | — | — | — | — | no oil |
| 6 | 160 | 140 | 190 | 50 | — | — | — | — | — | no oil |
| 7 | 160 | 145 | 190 | 45 | — | — | — | — | — | no oil |
| 8 | — | — | — | — | — | — | — | — | — | no oil |
| " | 125 | 125 | 220 | 95 | 150 | 200 | 50 | 80 | 23 | with oil |
| 9 | 140 | 140 | 200 | 60 | — | — | — | — | — | no oil |
| 10 | 105 | 110 | 170 | 60 | 120 | 160 | 40 | 72 | 28 | no oil |
| " | 105 | 110 | 205 | 95 | 120 | 185 | 65 | 70 | 31 | with oil |
| 11 | 115 | 115 | 145 | 30 | 120 | 145 | 25 | 77 | 26 | no oil |
| " | 115 | 115 | 180 | 65 | 120 | 170 | 50 | 75 | 29 | with oil |
| 12 | 115 | 115 | 145 | 30 | 120 | 145 | 25 | 76 | 26 | no oil |
| " | 115 | 115 | 180 | 65 | 120 | 170 | 50 | 73 | 28 | with oil |
| 13 | 115 | 115 | 145 | 30 | 120 | 145 | 25 | 77 | 25 | no oil |
| " | 115 | 115 | 180 | 65 | 120 | 170 | 50 | 73 | 30 | with oil |

TABLE 2

| | | Anti-offset characteristic | | | Color-mixing range | | | | | |
|---|---|---|---|---|---|---|---|---|---|---|
| | | Lower | Higher | Non-offset | Lower | Higher | | Transparency | | Fixing mode |
| Comp. Example | Fixability $T_{FI}$ (°C.) | limit (°C.) | limit (°C.) | range (°C.) | limit (°C.) | limit (°C.) | Range (°C.) | Tp (%) | Haze (—) | with oil or no oil |
| Comp. 1 | 165 | 155 | 190 | 35 | — | — | — | — | — | no oil |
| Ex. 2 | 165 | 155 | 195 | 40 | — | — | — | — | — | no oil |
| 3 | none | none | none | none | none | none | none | — | — | no oil |
| " | 130 | 130 | 220 | 90 | 160 | 205 | 45 | 56 | 39 | with oil |
| 4 | 150 | 150 | 190 | 40 | — | — | — | — | — | no oil |
| 5 | none | none | none | none | none | none | none | — | — | no oil |
| " | 160 | 160 | 220 | 60 | 170 | 200 | 30 | 83 | 21 | with oil |
| 6 | 145 | 145 | 175 | 30 | 150 | 170 | 20 | 53 | 47 | no oil |
| " | 145 | 145 | 190 | 45 | 150 | 175 | 25 | 46 | 52 | with oil |

The term "none" represents that no temperature range was found where the toner images were fixed well onto plain paper without causing offset so that no color-mixing range causing good color mixing was found either.

EXAMPLE 14

| | |
|---|---|
| Styrene-butyl acrylate/divinylbenzene (80/16/4 by weight) copolymer (Mw = ca. $5 \times 10^4$; RI = 1.57) | 1000 wt. parts |
| Magnetic iron oxide (Dav = 0.25 μm, Ms = 60 emu/g, Mr = 10 emu/g, Hc = 120 oersted) | 800 wt. parts |
| Di-t-butylsalicylic acid metal compound | 20 wt. parts |
| Mono-functional ester B-1 | 40 wt. parts |

The magnetic toner was charged in a commercially available electro-photographic copier ("NP-8582", available from Canon K.K.) to form yet unfixed toner images, which were then subjected to evaluation of fixability and anti-offset characteristic in the manners described hereinbefore.

The results are summarized in Table 3 appearing hereinafter.

Example 15

| | |
|---|---|
| Styrene/butyl acrylate/divinylbenzene (80/16/4) copolymer (Mw = ca. $5 \times 10^4$) | 1000 wt. parts |
| Magnetic iron oxide (Dav. = 0.25 μm, Ms = 60 emu/g, Mr = 10 emu/g, Hc = 120 oersted) | 800 wt. parts |
| Di-t-butylsalicylic acid metal compound | 20 wt. parts |
| Mono-functional ester B-2 | 40 wt. parts |

A magnetic toner was prepared and evaluated in the same manner as in Example 14 except for the use of the above ingredients. The magnetic toner showed a weight-average particle size of 8.2 μm.

The results are also shown in Table 3 appearing hereinafter.

EXAMPLE 16

| | |
|---|---|
| Styrene/butyl acrylate/divinylbenzene (80/16/4) copolymer (Mw = ca. $5 \times 10^4$) | 1000 wt. parts |
| Magnetic iron oxide (Dav. = 0.25 μm, Ms = 60 emu/g, Mr = 10 emu/g, Hc = 120 oersted) | 800 wt. parts |
| Di-t-butylsalicylic acid metal compound | 20 wt. parts |
| Mono-functional ester B-3 | 40 wt. parts |

A magnetic toner was prepared and evaluated in the same manner as in Example 14 except for the use of the above ingredients. The magnetic toner showed a weight-average particle size of 8.3 μm.

The results are also shown in Table 3 appearing hereinafter.

EXAMPLE 17

| | |
|---|---|
| Styrene/butyl acrylate/divinylbenzene (80/16/4) copolymer (Mw = ca. $5 \times 10^4$) | 1000 wt. parts |
| Magnetic iron oxide (Dav. = 0.25 μm, Ms = 60 emu/g, Mr = 10 emu/g, Hc = 120 oersted) | 800 wt. parts |
| Di-t-butylsalicylic acid metal compound | 20 wt. parts |
| Mono-functional ester B-4 | 40 wt. parts |

A magnetic toner was prepared and evaluated in the same manner as in Example 14 except for the use of the above ingredients. The magnetic toner showed a weight-average particle size of 8.4 μm.

The results are also shown in Table 3 appearing hereinafter.

EXAMPLE 18

| | |
|---|---|
| Polyester resin (bisphenol A-type diol/terephthalic acid/trimellitic acid (50/45/5) condensate) (Mw = ca. $5.0 \times 10^4$) | 1000 wt. parts |
| Copper-phthalocyanine pigment | 40 wt. parts |
| Monoazo metal compound | 20 wt. parts |
| Mono-functional ester B-1 | 40 wt. parts |

A cyan color toner having a weight-average particle size of 8.0 μm was prepared in the same manner as in Example 14 except for the use of the above ingredients. The toner in 100 wt. parts was blended with 1.2 wt. parts of hydrophobic titanium oxide fine powder externally added thereto to obtain a cyan color toner comprising toner particles carrying the titanium oxide fine powder attached onto the surfaces thereof.

6 wt. parts of the cyan toner was blended with 94 wt. parts of a ferrite carrier coated with acrylic resin to obtain a two-component type developer.

The developer was evaluated in the same manner as in Example 8.

The results are also shown in Table 3 appearing hereinafter.

EXAMPLE 19

452 wt. parts of 0.1M-$Na_3PO_4$ aqueous solution was added to 708 wt. parts of deionized water, and the mixture was warmed at 60° C. and stirred at 1200 rpm by a TK-type homomixer (available from Tokushu Kika Kogyo K.K.), followed by gradual addition of 69 wt. parts of 1.0M-$CaCl_2$ aqueous solution, to obtain an aqueous medium containing $Ca_3(PO_4)_2$. Separately, the following materials for providing a polymerizable monomer mixture were provided:

| | |
|---|---|
| Styrene | 165 wt. parts |
| n-Butyl acrylate | 35 wt. parts |
| Magnetic iron oxide (Dav. = 0.25 μm, Ms = 60 emu/g, Mr = 10 emu/g, Hc = 120 oersted) | 95 wt. parts |
| Styrene/methacrylic acid/methyl methacrylate (85/5/10) copolymer (Mw = ca. $5.7 \times 10^4$) | 9 wt. parts |
| Divinylbenzene | 2 wt. parts |
| Di-t-butylsalicylic acid metal compound | 2 wt. parts |
| Mono-functional ester B-1 | 40 wt. parts |

The above materials were warmed at 60° C. and stirred at 12000 rpm by a TK-type homomixer to effect uniform dissolution and dispersion. In the mixture, 10 wt. parts of 2,2'-azobis(2,4-dimethylvaleronitrile) as a polymerization initiator was dissolved, to form a polymerizable monomer mixture. The monomer mixture was then charged into the above-prepared aqueous medium and was formed into particles by stirring for 20 min. at 10000 rpm by a TK-type homomixer at 60° C. in an $N_2$ environment. Thereafter, the system was stirred by a paddle stirrer and heated at 80° C. to effect 10 hours of reaction.

After the reaction, the system was cooled, and hydrochloric acid was added thereto to dissolve the calcium phosphate, followed by filtration, washing with water and drying to obtain polymerizate particles.

To 100 wt. parts of the polymerizate particles, 0.8 wt. part of hydrophobic silica fine powder (BET specific surface area=200 $m^2/g$) was added to obtain a magnetic toner. The magnetic toner showed a weight-average particle size of 8.1 μm.

The magnetic toner was evaluated in the same manner as in Example 14. The results are also shown in Table 3.

EXAMPLE 20

| | |
|---|---|
| Styrene | 165 wt. parts |
| n-Butyl acrylate | 35 wt. parts |

-continued

| | |
|---|---|
| Copper-phthalocyanine pigment | 14 wt. parts |
| Styrene/methacrylic acid/methyl methacrylate (85/5/10) copolymer (Mw = ca. $5.7 \times 10^4$) | 9 wt. parts |
| Monoazo metal compound | 2 wt. parts |
| Mono-functional ester B-1 | 40 wt. parts |

A cyan color toner having a weight-average particle size of 8.2 μm was prepared in the same manner as in Example 19 except for the use of the above polymerizable mixture composition. Hydrophobic titanium oxide fine powder in 1.2 wt. parts was externally added to 100 wt. parts of the toner to obtain a color toner comprising toner particles carrying the titanium oxide fine powder attached to the surfaces thereof.

6 wt. parts of the color toner was blended with 94 wt. parts of a ferrite carrier coated with acrylic resin to obtain a two-component type developer.

The developer was evaluated in the same manner as in Example 10.

The results are also shown in Table 3 appearing hereinafter.

Example 21

| | |
|---|---|
| Styrene | 165 wt. parts |
| n-Butyl acrylate | 35 wt. parts |
| Copper-phthalocyanine pigment | 14 wt. parts |
| Styrene/methacrylic acid/methyl methacrylate (85/5/10) copolymer (Mw = ca. $5.7 \times 10^4$) | 9 wt. parts |
| Monoazo metal compound | 2 wt. parts |
| Mono-functional ester B-1 | 20 wt. parts |

A cyan color toner having a weight-average particle size of 8.0 μm was prepared and evaluated in the same manner as in Example 20 except for the use of the above polymerizable mixture composition.

The results are also shown in Table 3.

Example 22

| | |
|---|---|
| Styrene | 165 wt. parts |
| n-Butyl acrylate | 35 wt. parts |
| Quinacridone pigment | 16 wt. parts |
| Styrene/methacrylic acid/methyl methacrylate (85/5/10) copolymer (Mw = ca. $5.7 \times 10^4$) | 9 wt. parts |
| Monoazo metal compound | 2 wt. parts |
| Mono-functional ester B-1 | 20 wt. parts |

A magenta color toner having a weight-average particle size of 8.0 μm was prepared and evaluated in the same manner as in Example 20 except for the use of the above polymerizable mixture composition.

The results are also shown in Table 3.

EXAMPLE 23

| | |
|---|---|
| Styrene | 165 wt. parts |
| n-Butyl acrylate | 35 wt. parts |
| Disazo yellow pigment | 13 wt. parts |
| Styrene/methacrylic acid/methyl methacrylate (85/5/10) copolymer (Mw = ca. $5.7 \times 10^4$) | 9 wt. parts |
| Monoazo metal compound | 2 wt. parts |
| Mono-functional ester B-1 | 20 wt. parts |

A yellow color toner having a weight-average particle size of 8.1 μm was prepared and evaluated in the same manner as in Example 20 except for the use of the above polymerizable mixture composition.

The results are also shown in Table 3.

TABLE 3

| | | Anti-offset characteristic | | | Color-mixing range | | | Transparency | | Fixing mode |
|---|---|---|---|---|---|---|---|---|---|---|
| Example | Fixability $T_{F1}$ (°C.) | Lower limit (°C.) | Higher limit (°C.) | Non-offset range (°C.) | Lower limit (°C.) | Higher limit (°C.) | Range (°C.) | Tp (%) | Haze (–) | with oil or no oil |
| Ex. 14 | 155 | 135 | 210 | 75 | — | — | — | — | — | no oil |
| 15 | 155 | 135 | 205 | 70 | — | — | — | — | — | no oil |
| 16 | 150 | 140 | 200 | 60 | — | — | — | — | — | no oil |
| 17 | 155 | 140 | 200 | 60 | — | — | — | — | — | no oil |
| 18 | 135 | 130 | 220 | 90 | 160 | 200 | 40 | 75 | 25 | with oil |
| 19 | 145 | 145 | 200 | 55 | — | — | — | — | — | no oil |
| 20 | 115 | 115 | 170 | 55 | 120 | 160 | 40 | 72 | 33 | no oil |
| 20 | 115 | 115 | 205 | 90 | 125 | 185 | 60 | 69 | 34 | with oil |
| 21 | 115 | 120 | 145 | 25 | 120 | 145 | 25 | 75 | 28 | no oil |
| 21 | 115 | 120 | 180 | 60 | 120 | 170 | 50 | 74 | 30 | with oil |
| 22 | 115 | 120 | 145 | 25 | 120 | 145 | 25 | 75 | 29 | no oil |
| 22 | 115 | 120 | 180 | 60 | 120 | 170 | 50 | 71 | 30 | with oil |
| 23 | 115 | 120 | 145 | 25 | 120 | 145 | 25 | 76 | 27 | no oil |
| 23 | 115 | 120 | 180 | 60 | 120 | 170 | 50 | 71 | 31 | with oil |

EXAMPLE 24

| | |
|---|---|
| Styrene-butyl acrylate/divinylbenzene (80/16/4 by weight) copolymer (Mw = ca. $5 \times 10^4$; RI = 1.57) | 1000 wt. parts |
| Magnetic iron oxide (Dav. = 0.25 μm, Ms = 60 emu/g, Mr = 10 emu/g, Hc = 120 oersted) | 800 wt. parts |

-continued

| | |
|---|---|
| Di-t-butylsalicylic acid metal compound | 20 wt. parts |
| Polyfunctional ester C-1 | 40 wt. parts |

The above ingredients were preliminarily blended and then melt-kneaded through a twin-screw kneading extruder. After cooling, the kneaded product was coarsely crushed and finely pulverized by a pulverizer utilizing a jet air stream, followed by classification by a pneumatic classifier to obtain a magnetic toner having a weight-average particle size of 8.0 μm. The magnetic toner in 100 wt. parts was blended with 0.7 wt. part of hydrophobic colloidal silica fine powder externally added thereto to obtain a magnetic toner comprising toner particles carrying colloidal silica fine powder on the surface thereof.

The magnetic toner was charged in a commercially available electro-photographic copier ("NP-8582", available from Canon K.K.) to form yet unfixed toner images, which were then subjected to evaluation of fixability and anti-offset characteristic in the manners described hereinbefore.

The results are summarized in Table 4 appearing hereinafter.

EXAMPLE 25

| | |
|---|---|
| Styrene/butyl acrylate/divinylbenzene (80/16/4) copolymer (Mw = ca. $5 \times 10^4$) | 1000 wt. parts |
| Magnetic iron oxide (Dav. = 0.25 μm, Ms = 60 emu/g, Mr = 10 emu/g, Hc = 120 oersted) | 800 wt. parts |
| Di-t-butylsalicylic acid metal compound | 20 wt. parts |
| Polyfunctional ester C-2 | 40 wt. parts |

A magnetic toner was prepared and evaluated in the same manner as in Example 24 except for the use of the above ingredients. The magnetic toner showed a weight-average particle size of 8.2 μm.

The results are also shown in Table 4 appearing hereinafter.

EXAMPLE 26

| | |
|---|---|
| Styrene/butyl acrylate/divinylbenzene (80/16/4) copolymer (Mw = ca. $5 \times 10^4$) | 1000 wt. parts |
| Magnetic iron oxide (Dav. = 0.25 μm, Ms = 60 emu/g, Mr = 10 emu/g, Hc = 120 oersted) | 800 wt. parts |
| Di-t-butylsalicylic acid metal compound | 20 wt. parts |
| Polyfunctional ester C-3 | 40 wt. parts |

A magnetic toner was prepared and evaluated in the same manner as in Example 24 except for the use of the above ingredients. The magnetic toner showed a weight-average particle size of 8.1 μm.

The results are also shown in Table 4 appearing hereinafter.

EXAMPLE 27

| | |
|---|---|
| Styrene/butyl acrylate/divinylbenzene (80/16/4) copolymer (Mw = ca. $5 \times 10^4$) | 1000 wt. parts |

-continued

| | |
|---|---|
| Magnetic iron oxide (Dav. = 0.25 μm, Ms = 60 emu/g, Mr = 10 emu/g, Hc = 120 oersted) | 800 wt. parts |
| Di-t-butylsalicylic acid metal compound | 20 wt. parts |
| Polyfunctional ester C-4 | 40 wt. parts |

A magnetic toner was prepared and evaluated in the same manner as in Example 24 except for the use of the above ingredients. The magnetic toner showed a weight-average particle size of 8.0 μm.

The results are also shown in Table 4 appearing hereinafter.

EXAMPLE 28

| | |
|---|---|
| Polyester resin (bisphenol A-type diol/terephthalic acid/trimellitic acid (50/45/5) condensate) (Mw = ca. $5 \times 10^4$) | 1000 wt. parts |
| Copper-phthalocyanine pigment | 40 wt. parts |
| Monoazo metal compound | 20 wt. parts |
| Polyfunctional ester C-1 | 40 wt. parts |

A cyan color toner having a weight-average particle size of 7.9 μm was prepared in the same manner as in Example 24 except for the use of the above ingredients. The toner in 100 wt. parts was blended with 1.2 wt. parts of hydrophobic titanium oxide fine powder externally added thereto to obtain a cyan color toner comprising toner particles carrying the titanium oxide fine powder attached onto the surfaces thereof.

6 wt. parts of the cyan toner was blended with 94 wt. parts of a ferrite carrier coated with acrylic resin to obtain a two-component type developer.

The developer was evaluated in the same manner as in Example 8.

The results are also shown in Table 4 appearing hereinafter.

EXAMPLE 29

452 wt. parts of 0.1M-$Na_3PO_4$ aqueous solution was added to 708 wt. parts of deionized water, and the mixture was warmed at 60° C. and stirred at 1200 rpm by a TK-type homomixer (available from Tokushu Kika Kogyo K.K.), followed by gradual addition of 69 wt. parts of 1.0M-$CaCl_2$ aqueous solution, to obtain an aqueous medium containing $Ca_3(PO_4)_2$. Separately, the following materials for providing a polymerizable monomer mixture were provided:

| | |
|---|---|
| Styrene | 165 wt. parts |
| n-Butyl acrylate | 35 wt. parts |
| Magnetic iron oxide (Dav. = 0.25 μm, Ms = 60 emu/g, Mr = 10 emu/g, Hc = 120 oersted) | 95 wt. parts |
| Styrene/methacrylic acid/methyl methacrylate (85/5/10) copolymer (Mw = ca. $5.7 \times 10^4$) | 9 wt. parts |
| Divinylbenzene | 2 wt. parts |
| Di-t-butylsalicylic acid metal compound | 2 wt. parts |
| Polyfunctional ester C-1 | 40 wt. parts |

The above materials were warmed at 60° C. and stirred at 12000 rpm by a TK-type homomixer to effect uniform dissolution and dispersion. In the mixture, 10 wt. parts of 2,2'-azobis(2,4-dimethylvaleronitrile) as a polymerization initiator was dissolved, to form a polymerizable monomer mixture. The monomer mixture was then charged into the above-prepared aqueous medium and was formed into particles by stirring for 20 min. at 10000 rpm by a TK-type homomixer at 60° C. in an $N_2$ environment. Thereafter, the system was stirred by a paddle stirrer and heated at 80° C. to effect 10 hours of reaction.

After the reaction, the system was cooled, and hydrochloric acid was added thereto to dissolve the calcium phosphate, followed by filtration, washing with water and drying to obtain polymerizate particles.

To 100 wt. parts of the polymerizate particles, 0.8 wt. part of hydrophobic silica fine powder (BET specific surface area=200 $m^2/g$) was added to obtain a magnetic toner. The magnetic toner showed a weight-average particle size of 8.1 μm.

The magnetic toner was evaluated in the same manner as in Example 24. The results are also shown in Table 4.

EXAMPLE 30

| | |
|---|---|
| Styrene | 165 wt. parts |
| n-Butyl acrylate | 35 wt. parts |
| Copper-phthalocyanine pigment | 14 wt. parts |
| Styrene/methacrylic acid/methyl methacrylate (85/5/10) copolymer (Mw = ca. $5.7 \times 10^4$) | 9 wt. parts |
| Monoazo metal compound | 2 wt. parts |
| Polyfunctional ester C-1 | 40 wt. parts |

A color toner having a weight-average particle size of 8.2 μm was prepared in the same manner as in Example 29 except for the use of the above polymerizable mixture composition. Hydrophobic titanium oxide fine powder in 1.2 wt. parts was externally added to 100 wt. parts of the toner to obtain a color toner comprising toner particles carrying the titanium oxide fine powder attached to the surfaces thereof.

6 wt. parts of the color toner was blended with 94 wt. parts of a ferrite carrier coated with acrylic resin to obtain a two-component type developer.

The developer was evaluated in the same manner as in Example 10.

The results are also shown in Table 4 appearing hereinafter.

EXAMPLE 31

| | |
|---|---|
| Styrene | 165 wt. parts |
| n-Butyl acrylate | 35 wt. parts |
| Copper-phthalocyanine pigment | 14 wt. parts |
| Styrene/methacrylic acid/methyl methacrylate (85/5/10) copolymer (Mw = ca. $5.7 \times 10^4$) | 9 wt. parts |
| Monoazo metal compound | 2 wt. parts |
| Polyfunctional ester C-1 | 20 wt. parts |

A cyan color toner having a weight-average particle size of 8.0 μm was prepared and evaluated in the same manner as in Example 30 except for the use of the above polymerizable mixture composition.

The results are also shown in Table 4.

EXAMPLE 32

| | |
|---|---|
| Styrene | 165 wt. parts |
| n-Butyl acrylate | 35 wt. parts |
| Quinacridone pigment | 16 wt. parts |
| Styrene/methacrylic acid/methyl methacrylate (85/5/10) copolymer (Mw = ca. $5.7 \times 10^4$) | 9 wt. parts |
| Monoazo metal compound | 2 wt. parts |
| Polyfunctional ester C-1 | 20 wt. parts |

A magenta color toner having a weight-average particle size of 8.0 μm was prepared and evaluated in the same manner as in Example 30 except for the use of the above polymerizable mixture composition.

The results are also shown in Table 4.

Example 33

| | |
|---|---|
| Styrene | 165 wt. parts |
| n-Butyl acrylate | 35 wt. parts |
| Disazo yellow pigment | 13 wt. parts |
| Styrene/methacrylic acid/methyl methacrylate (85/5/10) copolymer (Mw = ca. $5.7 \times 10^4$) | 9 wt. parts |
| Monoazo metal compound | 2 wt. parts |
| Polyfunctional ester C-1 | 20 wt. parts |

A yellow color toner having a weight-average particle size of 8.1 μm was prepared and evaluated in the same manner as in Example 30 except for the use of the above polymerizable mixture composition.

The results are also shown in Table 4.

TABLE 4

| | | Anti-offset characteristic | | | Color-mixing range | | | | | |
|---|---|---|---|---|---|---|---|---|---|---|
| | | Lower | Higher | Non-offset | Lower | Higher | | Transparency | | Fixing mode |
| Example | Fixability $T_{FI}$ (°C.) | limit (°C.) | limit (°C.) | range (°C.) | limit (°C.) | limit (°C.) | Range (°C.) | Tp (%) | Haze (–) | with oil or no oil |
| Ex. 24 | 150 | 135 | 215 | 80 | — | — | — | — | — | no oil |
| 25 | 150 | 135 | 210 | 75 | — | — | — | — | — | no oil |
| 26 | 155 | 135 | 200 | 65 | — | — | — | — | — | no oil |
| 27 | 160 | 135 | 200 | 65 | — | — | — | — | — | no oil |
| 28 | 130 | 130 | 220 | 90 | 155 | 200 | 45 | 78 | 23 | with oil |
| 29 | 140 | 140 | 195 | 55 | — | — | — | — | — | no oil |
| 30 | 110 | 115 | 170 | 55 | 120 | 160 | 40 | 70 | 30 | no oil |
| 30 | 110 | 115 | 205 | 90 | 120 | 185 | 65 | 69 | 32 | with oil |

TABLE 4-continued

| Example | Fixability $T_{FI}$ (°C.) | Anti-offset characteristic: Lower limit (°C.) | Anti-offset characteristic: Higher limit (°C.) | Anti-offset characteristic: Non-offset range (°C.) | Color-mixing range: Lower limit (°C.) | Color-mixing range: Higher limit (°C.) | Color-mixing range: Range (°C.) | Transparency: Tp (%) | Transparency: Haze (–) | Fixing mode with oil or no oil |
|---|---|---|---|---|---|---|---|---|---|---|
| 31 | 115 | 120 | 150 | 30 | 120 | 145 | 25 | 77 | 28 | no oil |
| 31 | 115 | 120 | 180 | 60 | 120 | 170 | 50 | 75 | 32 | with oil |
| 32 | 115 | 120 | 150 | 30 | 120 | 145 | 25 | 76 | 29 | no oil |
| 32 | 115 | 120 | 180 | 60 | 120 | 170 | 50 | 73 | 30 | with oil |
| 33 | 115 | 120 | 150 | 30 | 120 | 145 | 25 | 77 | 27 | no oil |
| 33 | 115 | 120 | 180 | 60 | 120 | 170 | 50 | 73 | 33 | with oil |

What is claimed is:

1. A toner for developing an electrostatic latent image, comprising: a binder resin, a colorant, and a release agent in amounts from 1–40 wt. parts per 100 wt. parts of the binder resin, said release agent comprising an ester compound having 1 to 4 ester groups selected from the group consisting of ester compounds (a), (b) and (c) shown below:

(a) a poly-functional ester having a tertiary carbon or/and a quaternary carbon and obtained from an alcohol compound or carboxylic compound having at least two functional groups, (b) a mono-functional ester having a tertiary carbon or/and a quaternary carbon, and (c) a poly-functional ester having a primary or secondary carbon having at least two functional groups represented by the following formula (1):

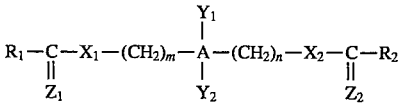

(1)

wherein A denotes a carbon atom or alicyclic group, $R_1$ and $R_2$ independently denote an organic group having 1–35 carbon atoms, $Y_1$ and $Y_2$ independently denote a hydrogen atom, halogen atom or organic group, m and n denote 0 or an integer of at least 1 , $X_1$ and $X_2$ independently denote an oxygen atom or sulfur atom, and $Z_1$ and $Z_2$ independently denote an oxygen atom or sulfur atom, with the proviso that at least one of $Y_1$ and $Y_2$ denotes an organic group when A denotes a carbon atom and m and n are 0, at least one of $Y_1$ and $Y_2$ denotes a hydrogen atom or halogen atom when A denotes a carbon atom and either one of m and n denotes an integer of at least 1, and $Y_1$ and $Y_2$ denote a hydrogen atom or halogen atom with the proviso that at least one of $Y_1$ and $Y_2$ is a halogen atom when A denotes a carbon atom and m and n are an integer of at least 1.

2. The toner according to claim 1, which comprises the poly-functional ester (a).

3. The toner according to claim 2, wherein the ester compound is a poly-functional ester represented by the following formula (2):

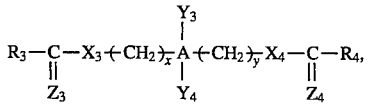

(2)

wherein $A_2$ denotes a carbon atom, alicyclic group or aromatic group, $R_3$ and $R_4$ independently denote an organic group having 1–35 carbon atoms, $Y_3$ and $Y_4$ independently denote a hydrogen atom, halogen atom or organic group, x and y denote zero or an integer of at least 1, $X_3$ and $X_4$ independently denote an oxygen atom or sulfur atom, and $Z_3$ and $Z_4$ independently denote an oxygen atom or sulfur atom with the proviso that x and y denote an integer of at least 1 when $A_2$ denotes a carbon atom and either one of $Y_3$ and $Y_4$ denotes an organic group; either one of x and y denotes an integer of at least 1 when $A_2$ denotes a carbon atom and $Y_3$ and $Y_4$ both denote an organic group; x and y denote 0 or an integer of at least 1 when $A_2$ denotes an aromatic group having $Y_3$ and $Y_4$; and at least one of $Y_3$ and $Y_4$ denotes an organic group when $A_2$ denotes an alicyclic group having $Y_3$ and $Y_4$ and x and y are 0.

4. The toner according to claim 3, wherein $Y_3$ is an organic group represented by the following formula:

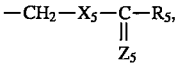

wherein $R_5$ denotes an organic group having 1–35 carbon atoms, $X_5$ denotes an oxygen or sulfur atom, and $Z_5$ denotes an oxygen or sulfur atom.

5. The toner according to claim 3, wherein $Y_4$ is an organic group represented by the following formula:

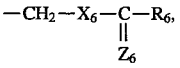

wherein $R_6$ denotes an organic group having 1–35 carbon atoms, $X_6$ denotes an oxygen or sulfur atom, and $Z_6$ denotes an oxygen or sulfur atom.

6. The toner according to claim 3, wherein $R_3$ and $R_4$ denote an organic group having 10–35 carbon atoms, and $R_5$ and $R_6$ denote an organic group having 1– 5 carbon atoms.

7. The toner according to claim 6, wherein $R_3$ and $R_4$ denote an alkyl, alkenyl or aromatic group, and $R_5$ and $R_6$ denote an alkyl group.

8. The toner according to claim 3, wherein the ester compound is a poly-functional ester represented by the following formula:

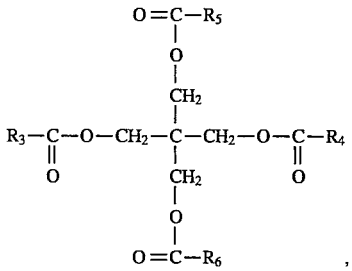

wherein $R_3$ and $R_4$ denote an alkyl or alkenyl group having 11–30 carbon atoms, and $R_5$ and $R_6$ denote an alkyl group having 1–10 carbon atoms.

9. The toner according to claim 1, wherein the ester compound is a mono-functional ester represented by the following structural formula (3):

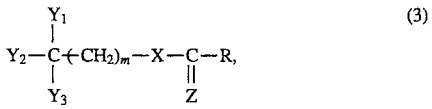

(3)

wherein R denotes an organic group having 1–35 carbon atoms: $Y_1$, $Y_2$ and $Y_3$ independently denote a hydrogen atom, halogen atom or organic group; X denotes an oxygen or sulfur atom; Z denotes an oxygen or sulfur atom; and m denotes zero or an integer of at least 1 with the proviso that $Y_1$, $Y_2$ and $Y_3$ respectively denote an organic group when m=0.

10. The toner according to claim 1, wherein the ester compound is a poly-functional ester represented by the formula (1) wherein $Y_1$ is an organic group represented by the formula:

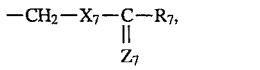

wherein $R_7$ denotes an organic group having 1–35 carbon atoms, $X_7$ denotes an oxygen or sulfur atom, and $Z_7$ denotes an oxygen or sulfur atom.

11. The toner according to claim 1, wherein the ester compound is a poly-functional ester represented by the formula (1) wherein $Y_2$ is an organic group represented by the formula:

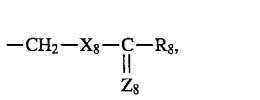

wherein $R_8$ denotes an organic group having 1–35 carbon atoms, $X_8$ denotes an oxygen or sulfur atom, and $Z_8$ denotes an oxygen or sulfur atom.

12. The toner according to claim 1, wherein the ester compound is contained in an amount of 2–30 wt. parts per 100 wt. parts of the binder resin.

13. The toner according to claim 1, wherein the binder resin has a refractive index which differs by at most 0.18 from that of the ester compound.

14. The toner according to claim 13, wherein the binder resin has a refractive index which differs by at most 0.10 from that of the ester compound.

15. The toner according to claim 1, wherein the ester compound has a melting point of 30°–120° C.

16. The toner according to claim 15, wherein the ester compound has a melting point of 50°–100° C.

17. The toner according to claim 1, wherein the ester compound has a solubility parameter (SP value) of 7.5–9.7.

18. The toner according to claim 1, wherein the ester compound has a melt viscosity of 1–300 cps at 130° C.

19. The toner according to claim 18, wherein the ester compound has a melt viscosity of 3–50 cps at 130° C.

20. The toner according to claim 20, wherein the ester compound has a hardness of 0.3–5.0.

21. The toner according to claim 1, wherein the ester compound has a hardness of 0.5–3.0.

22. The toner according to claim 1, wherein the ester compound has a crystallinity of 10–50%.

23. The toner according to claim 22, wherein the ester compound has a crystallinity of 20–35%.

24. The toner according to claim 1, wherein the ester compound has a number-average molecular weight of 200–2000.

25. The toner according to claim 24, wherein the ester compound has a number-average molecular weight of 500–1000.

26. The toner according to claim 1, wherein the binder resin comprises a styrene copolymer.

27. The toner according to claim 1, wherein the binder resin comprises a polyester resin.

28. A process for producing a toner, comprising the steps of:

(i) melt-kneading a mixture including a binder resin, a colorant, and a release agent in amounts from 1–40 wt. parts per 100 wt. parts of the binder resin, said release agent comprising an ester compound having 1 to 4 ester groups selected from the group consisting of ester compounds (a), (b) and (c) shown below:

(a) a poly-functional ester having a tertiary carbon or/and a quaternary carbon and obtained from an alcohol compound or carboxylic compound having at least two functional groups, (b) a mono-functional ester having a tertiary carbon or/and a quaternary carbon, and (c) a poly-functional ester having a primary or secondary carbon having at least two functional groups represented by the following formula (1):

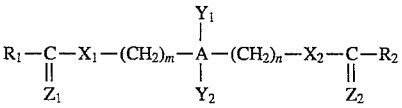

(1)

wherein A denotes a carbon atom or alicyclic group, $R_1$ and $R_2$ independently denote an organic group having 1–35 carbon atoms, $Y_1$ and $Y_2$ independently denote a hydrogen atom, halogen atom or organic group, m and n denote 0 or an integer of at least 1, $X_1$ and $X_2$ independently denote an oxygen atom or sulfur atom, and $Z_1$ and $Z_2$ independently denote an oxygen atom or sulfur atom, with the proviso that at least one of $Y_1$ and $Y_2$ denotes an organic group when A denotes a carbon atom and m and n are 0, at least one of $Y_1$ and $Y_2$ denotes a hydrogen atom or halogen atom when A denotes a carbon atom and either one of m and n denotes an integer of at least 1, and $Y_1$ and $Y_2$ denote a hydrogen atom or halogen atom with the proviso that at least one of $Y_1$ and $Y_2$ is a halogen atom when A denotes a carbon atom and m and n are an integer of at least 1, thereby to form a melt-kneaded product, (ii) cooling the melt-kneaded product, (iii) pulverizing the cooled melt-kneaded product to obtain a pulverized product, and (iv) classifying the pulverized product to obtain toner particles.

29. The process according to claim 28, wherein the ester compound is used in an amount of 1–10 wt. parts per 100 wt. parts of the binder resin.

30. The process according to claim 29, wherein the ester compound is used in an amount of 2–5 wt. parts per 100 wt. parts of the binder resin.

31. The process according to claim 28, wherein the binder resin comprises a styrene copolymer.

32. The process according to claim 28, wherein the binder resin comprises a polyester resin.

33. A process for producing a toner, comprising the steps of:

(i) forming into particles a mixture including a polymerizable monomer, a colorant, and a release agent in amounts from 1–40 wt. parts per 100 wt. parts of the binder resin, said release agent comprising an ester compound having 1 to 4 ester groups selected from the group consisting of ester compounds (a), (b) and (c) shown below:

(a) a poly-functional ester having a tertiary carbon or/and a quaternary carbon and obtained from an alcohol compound or carboxylic compound having at least two functional groups, (b) a mono-functional ester having a tertiary carbon or/and a quaternary carbon, and (c) a poly-functional ester having a primary or secondary carbon having at least two functional groups represented by the following formula (1):

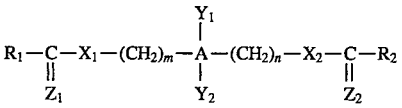

(1)

wherein A denotes a carbon atom or alicyclic group, $R_1$ and $R_2$ independently denote an organic group having 1–35 carbon atoms, $Y_1$ and $Y_2$ independently denote a hydrogen atom, halogen atom or organic group, m and n denote 0 or an integer of at least 1, $X_1$ and $X_2$ independently denote an oxygen atom or sulfur atom, and $Z_1$ and $Z_2$ independently denote an oxygen atom or sulfur atom, with the proviso that at least one of $Y_1$ and $Y_2$ denotes an organic group when A denotes a carbon atom and m and n are 0, at least one of $Y_1$ and $Y_2$ denotes a hydrogen atom or halogen atom when A denotes a carbon atom and either one of m and n denotes an integer of at least 1, and $Y_1$ and $Y_2$ denote a hydrogen atom or halogen atom with the proviso that at least one of $Y_1$ and $Y_2$ is a halogen atom when A denotes a carbon atom and m and n are an integer of at least 1; and (ii) polymerizing the particles of the mixture to obtain toner particles.

34. The process according to claim 33, wherein the polymerizable monomer comprises a vinyl monomer.

35. The process according to claim 34, wherein the polymerizable monomer comprises a styrene-type monomer, an acrylic acid ester, a methacrylic acid ester, or a mixture thereof.

36. The process according to claim 33, wherein the mixture is formed into particles in an aqueous medium and subjected to polymerization in an aqueous medium.

37. The process according to claim 33, wherein the mixture further includes a polymer or copolymer having a polar group.

38. The process according to claim 37, wherein the copolymer having a polar group is a styrene-based copolymer.

39. The process according to claim 37, wherein the polymer having a polar group is a polyester resin.

* * * * *

UNITED STATES PATENT AND TRADEMARK OFFICE

CERTIFICATE OF CORRECTION

PATENT NO. : 5,510,222

DATED : April 23, 1996

INVENTOR(S) : Kohji Inaba et al.

It is certified that error appears in the above-identified patent and that said Letters Patent is hereby corrected as shown below:

On the title page item [56],
REFERENCES CITED

U.S. PATENT DOCUMENTS, "2,297,691 10/1947 Carlson...95/5" should read --2,297,691 10/1942 Carlson...95/5--.
Insert --OTHER PUBLICATIONS ¶ Fedors, "A Method For Estimating Both the Solubility Parameters and Molar Volumes of Liquids," Polymer Engineering and Science, Vol. 14, No. 2, 1974 (p. 147-154). ¶ Patent Abstracts of Japan, Vol. 13, No. 47CP-822 (3395), Feb. 3, 1989--.

COLUMN 1

Line 59, "uses" should read --uses,--.

COLUMN 2

Line 29, "a" should be deleted.

COLUMN 5

Formula (2), "$A_2$" should read --A--.
Line 35, "denoted" should read --denotes--.

COLUMN 15

Line 25, "avail-able" should read --available--.

COLUMN 17

Line 22, "to" should read --too--.

UNITED STATES PATENT AND TRADEMARK OFFICE

CERTIFICATE OF CORRECTION

PATENT NO. : 5,510,222

DATED : April 23, 1996

INVENTOR(S) : Kohji Inaba et al.

It is certified that error appears in the above-identified patent and that said Letters Patent is hereby corrected as shown below:

COLUMN 18

Line 41, "complexes" should read --complexes,--.

COLUMN 23

Line 36, "mixture." should read --in mixture.--.
Line 54, "artionic" should read --anionic--.

COLUMN 24

Line 44, "rubber" should read --rubber.--.

COLUMN 25

Line 49, "product was subjected" (second occurrence) should be deleted.

COLUMN 28

Line 33, "benzene" should read --benzene,--.

COLUMN 49

Line 57, "claim 20," should read --claim 1,--.
Line 59, "claim 1," should read --claim 20,--.

UNITED STATES PATENT AND TRADEMARK OFFICE

CERTIFICATE OF CORRECTION

PATENT NO. : 5,510,222

DATED : April 23, 1996

INVENTOR(S) : Kohji Inaba et al.

It is certified that error appears in the above-identified patent and that said Letters Patent is hereby corrected as shown below:

COLUMN 50

Line 26, "$(CH_2)_m$" should read --$(CH_2)_n$--.

COLUMN 51

Line 15, "$(CH_2)_m$" should read --$(CH_2)_n$--.

Signed and Sealed this

Seventeenth Day of September, 1996

*Attest:*

Bruce Lehman

BRUCE LEHMAN

*Attesting Officer*

*Commissioner of Patents and Trademarks*